US009061796B2

(12) United States Patent
Caldwell et al.

(10) Patent No.: US 9,061,796 B2
(45) Date of Patent: Jun. 23, 2015

(54) MULTI-FUNCTION CONDIMENT CONTAINER

(75) Inventors: Craig S. Caldwell, Slippery Rock, PA (US); John Marshall, Pittsburgh, PA (US); William F. Rasile, Allison Park, PA (US)

(73) Assignee: H.J. HEINZ COMPANY, Pittsburgh, PA (US)

( * ) Notice: Subject to any disclaimer, the term of this patent is extended or adjusted under 35 U.S.C. 154(b) by 191 days.

(21) Appl. No.: 12/766,164

(22) Filed: Apr. 23, 2010

(65) Prior Publication Data

US 2010/0270330 A1 Oct. 28, 2010

Related U.S. Application Data

(63) Continuation-in-part of application No. 12/766,091, filed on Apr. 23, 2010, now abandoned.

(60) Provisional application No. 61/202,968, filed on Apr. 23, 2009.

(51) Int. Cl.
*B29D 22/00* (2006.01)
*B65D 21/02* (2006.01)
(Continued)

(52) U.S. Cl.
CPC ..... *B65D 21/0202* (2013.01); *B65D 75/326* (2013.01); *B65D 85/72* (2013.01); *B65D 2221/00* (2013.01); *B65D 2313/00* (2013.01)

(58) Field of Classification Search
CPC ..... B65D 21/0202; B65D 2221/00; B65D 2313/00; B65D 75/326; B65D 85/72
USPC ..... 428/35.7; 426/122
See application file for complete search history.

(56) References Cited

U.S. PATENT DOCUMENTS 1,991,987 A 2/1935 Smith
2,550,815 A 5/1951 Inwood
2,617,568 A 11/1952 Pechtel
(Continued)

FOREIGN PATENT DOCUMENTS

CN 1146417 A 4/1997
CN 1210497 3/1999
(Continued)

OTHER PUBLICATIONS

Machine Translation of JP 2006199355 A; 2006.*
(Continued)

*Primary Examiner* — James Yager
(74) *Attorney, Agent, or Firm* — Greenblum & Bernstein, P.L.C.

(57) ABSTRACT

A container for condiments includes a container portion having generally planar bottom, a generally parallel flange, a discharge spout, and a sidewall extending between the bottom and the flange. A generally planar cover portion is secured to the flange by an adhesive such that there exists a non-bonded region between the cover and the flange. At least one section of the flange in the non-bonded region is bent downwardly away from the cover portion to form therebetween a finger-access gap. The sidewall includes a front portion disposed below the spout and extending downwardly with respect thereto. The sidewall front portion is configured to prevent the spout from becoming displaced upwardly in response to the sidewall front portion being contacted by the rear portion of another container in a package of the containers.

72 Claims, 15 Drawing Sheets

(51) Int. Cl.
*B65D 75/32* (2006.01)
*B65D 85/72* (2006.01)

(56) References Cited

U.S. PATENT DOCUMENTS

| | | | | |
|---|---|---|---|---|
| 2,705,579 | A | | 4/1955 | Mason |
| 2,898,003 | A | | 8/1959 | Wilson et al. |
| 3,301,392 | A | | 1/1967 | Regan, Jr. |
| 3,315,801 | A | | 4/1967 | Lowry |
| 3,342,326 | A | | 9/1967 | Zackheim |
| 3,370,757 | A | | 2/1968 | Foster |
| 3,407,969 | A | | 10/1968 | Klein et al. |
| 3,453,661 | A | | 7/1969 | Repko |
| 3,660,960 | A | | 5/1972 | Inman |
| 3,722,754 | A | | 3/1973 | Struble |
| 3,854,653 | A | | 12/1974 | Engelsberger |
| 3,873,735 | A | | 3/1975 | Chalin et al. |
| 4,090,660 | A | | 5/1978 | Schram et al. |
| 4,301,926 | A | | 11/1981 | Chung |
| 4,463,869 | A | | 8/1984 | Lewis |
| 4,566,613 | A | | 1/1986 | Anscomb |
| 4,648,506 | A | | 3/1987 | Campbell |
| 4,673,085 | A | | 6/1987 | Badouard et al. |
| 4,691,820 | A | | 9/1987 | Martinez |
| 4,717,046 | A | | 1/1988 | Brogli |
| 4,762,124 | A | | 8/1988 | Kerch et al. |
| 4,765,463 | A | | 8/1988 | Chanel |
| 4,834,247 | A | | 5/1989 | Oshima et al. |
| 4,854,466 | A | | 8/1989 | Lane, Jr. |
| 4,863,036 | A | | 9/1989 | Heijenga |
| 4,871,091 | A | | 10/1989 | Preziosi |
| 4,872,597 | A | | 10/1989 | Hanafusa |
| 4,921,137 | A | | 5/1990 | Heijenga |
| 4,963,045 | A | | 10/1990 | Willcox |
| 4,989,419 | A | | 2/1991 | Brando et al. |
| D317,690 | S | | 6/1991 | Thomsen |
| D318,795 | S | | 8/1991 | Christine |
| 5,038,974 | A | | 8/1991 | DaCosta |
| 5,111,932 | A | | 5/1992 | Campbell |
| 5,126,176 | A | * | 6/1992 | Blaskovitz et al. ..... 428/36.92 |
| 5,141,136 | A | | 8/1992 | Tignor |
| 5,156,329 | A | | 10/1992 | Farrell |
| D336,034 | S | | 6/1993 | Rebilas |
| 5,235,149 | A | | 8/1993 | Boehrer |
| 5,277,920 | A | | 1/1994 | Weaver, Jr. |
| D351,228 | S | | 10/1994 | Weiler et al. |
| D354,906 | S | | 1/1995 | Lane, Jr. et al. |
| 5,411,178 | A | | 5/1995 | Roders et al. |
| D362,595 | S | | 9/1995 | Schneider |
| 5,482,172 | A | | 1/1996 | Braddock |
| 5,529,224 | A | | 6/1996 | Chan et al. |
| 5,546,728 | A | | 8/1996 | Dekeyser |
| 5,613,517 | A | | 3/1997 | Handler |
| 5,662,245 | A | | 9/1997 | Grant |
| 5,706,961 | A | | 1/1998 | Morano |
| 5,799,838 | A | | 9/1998 | Miller |
| 5,806,726 | A | | 9/1998 | Ho |
| 5,839,609 | A | | 11/1998 | Zakensberg |
| 5,842,631 | A | | 12/1998 | Berger |
| 5,890,634 | A | | 4/1999 | Zuckerman et al. |
| D416,477 | S | | 11/1999 | Flint |
| 5,975,304 | A | | 11/1999 | Cain et al. |
| 5,996,845 | A | | 12/1999 | Chan |
| 6,007,264 | A | | 12/1999 | Koptis |
| 6,051,263 | A | | 4/2000 | Gorlich et al. |
| 6,062,413 | A | | 5/2000 | Redmond |
| 6,085,942 | A | | 7/2000 | Redmond |
| 6,089,375 | A | | 7/2000 | Johnson et al. |
| D435,440 | S | | 12/2000 | Croft et al. |
| 6,220,311 | B1 | | 4/2001 | Litto |
| D442,078 | S | | 5/2001 | Fuquen |
| 6,230,969 | B1 | | 5/2001 | Spransy |
| D448,661 | S | | 10/2001 | Kerr et al. |
| 6,357,631 | B1 | | 3/2002 | Zaksenberg |
| 6,391,406 | B1 | | 5/2002 | Zenner et al. |
| 6,419,118 | B1 | | 7/2002 | Rees et al. |
| 6,435,374 | B1 | | 8/2002 | Tabaroni |
| 6,460,781 | B1 | | 10/2002 | Garcia et al. |
| 6,499,595 | B1 | * | 12/2002 | Petricca ..... 206/356 |
| 6,557,731 | B1 | | 5/2003 | Lyon et al. |
| 6,601,737 | B1 | | 8/2003 | Sandler |
| 6,648,140 | B2 | | 11/2003 | Petricca |
| 6,663,019 | B2 | | 12/2003 | Garcia et al. |
| D484,972 | S | | 1/2004 | Steele, IV et al. |
| 6,702,462 | B2 | | 3/2004 | Richardson |
| 6,811,057 | B2 | | 11/2004 | Duquet et al. |
| 6,854,888 | B1 | | 2/2005 | Brown et al. |
| 6,863,178 | B2 | | 3/2005 | Sokolsky et al. |
| D505,861 | S | | 6/2005 | Risgalla |
| 6,955,028 | B1 | | 10/2005 | Dunaway |
| D512,648 | S | | 12/2005 | Smith et al. |
| 7,004,322 | B1 | | 2/2006 | Bartoli |
| D523,758 | S | | 6/2006 | Risgalla |
| D537,341 | S | | 2/2007 | Liebe et al. |
| RE39,520 | E | | 3/2007 | Hess et al. |
| D39,520 | S | | 3/2007 | Hess et al. |
| D553,007 | S | | 10/2007 | Goodwin et al. |
| D555,011 | S | | 11/2007 | Spanjaard |
| D580,782 | S | | 11/2008 | Murray |
| 7,506,762 | B2 | | 3/2009 | Nelson et al. |
| D598,299 | S | | 8/2009 | Isogai et al. |
| D604,637 | S | | 11/2009 | Ueda |
| 8,231,026 | B2 | | 7/2012 | White |
| 8,343,561 | B2 | | 1/2013 | Yasumuro et al. |
| 2001/0012531 | A1 | | 8/2001 | Abdullovski |
| 2001/0030192 | A1 | | 10/2001 | Redmond |
| 2001/0030227 | A1 | | 10/2001 | Fear et al. |
| 2001/0045374 | A1 | | 11/2001 | Selker |
| 2002/0100760 | A1 | | 8/2002 | Rinks |
| 2002/0148855 | A1 | | 10/2002 | Sokolsky et al. |
| 2003/0015605 | A1 | | 1/2003 | Garcia et al. |
| 2003/0183637 | A1 | | 10/2003 | Zappa et al. |
| 2005/0077297 | A1 | * | 4/2005 | Marshburn et al. ..... 220/359.2 |
| 2006/0278562 | A1 | | 12/2006 | Van Puijenbroek |
| 2007/0034647 | A1 | | 2/2007 | Patrick |
| 2007/0164045 | A1 | | 7/2007 | Wydler et al. |
| 2007/0199342 | A1 | | 8/2007 | Lee |
| 2007/0228073 | A1 | | 10/2007 | Mazzarino |
| 2008/0290089 | A1 | | 11/2008 | Ciarrocchi, Jr. |
| 2009/0071960 | A1 | | 3/2009 | Nagata et al. |
| 2010/0008602 | A1 | | 1/2010 | Risgalla |

FOREIGN PATENT DOCUMENTS

| | | | | |
|---|---|---|---|---|
| CN | 1258626 | | | 7/2000 |
| CN | 1814510 | | | 8/2006 |
| CN | 101024436 | | | 8/2007 |
| CN | 101171177 | | | 4/2008 |
| CN | 101426695 | | | 5/2009 |
| EP | 1234782 | | | 8/2002 |
| EP | 1518794 | | | 3/2005 |
| EP | 1693313 | | | 8/2006 |
| FR | 2801282 | | | 5/2001 |
| FR | 2 801 570 | A1 | | 6/2001 |
| GB | 2153778 | | | 8/1985 |
| GB | 2278338 | | | 11/1994 |
| JP | 52-38551 | | | 3/1977 |
| JP | 53124266 | A | | 10/1978 |
| JP | 58-028972 | | | 6/1983 |
| JP | 61-59558 | A | | 3/1986 |
| JP | 61-059558 | | | 4/1986 |
| JP | 61-93470 | A | | 5/1986 |
| JP | S62-122969 | | | 6/1987 |
| JP | 62219024 | A | | 9/1987 |
| JP | 62250997 | A | | 10/1987 |
| JP | 1-111680 | A | | 4/1989 |
| JP | 7-35172 | A | | 2/1995 |
| JP | 08-258875 | | | 10/1996 |
| JP | 11-1260 | | | 1/1999 |
| JP | 2000062801 | A | * | 2/2000 |
| JP | 2000-302177 | | | 10/2000 |
| JP | 2001328686 | | | 11/2001 |
| JP | 2002-179140 | | | 6/2002 |
| JP | 2002-302158 | | | 10/2002 |

(56) References Cited

FOREIGN PATENT DOCUMENTS

| | | | |
|---|---|---|---|
| JP | 2002-362628 | | 12/2002 |
| JP | 2003312750 | | 11/2003 |
| JP | 2004-224360 | | 8/2004 |
| JP | 2005313914 | | 11/2005 |
| JP | 2006-131263 | | 5/2006 |
| JP | 2006168805 | | 6/2006 |
| JP | 2006-213369 | | 8/2006 |
| JP | 2006199355 | A * | 8/2006 |
| JP | 2008-044645 | | 2/2008 |
| WO | WO86/07335 | | 12/1986 |
| WO | WO9418931 | | 9/1994 |
| WO | WO 97/28054 | | 8/1997 |
| WO | WO9910252 | | 3/1999 |
| WO | WO-02/070352 | | 9/2002 |
| WO | WO-2004/063048 | | 7/2004 |
| WO | WO2004113177 | | 12/2004 |
| WO | WO2005075317 | | 8/2005 |
| WO | WO2007080299 | | 7/2007 |
| WO | WO-2007/126817 | | 11/2007 |
| WO | WO2007135824 | | 11/2007 |

OTHER PUBLICATIONS

English Abstract of JP 2000062801 A; 2000.*

HP Series 02 Ink Cartridge Packaging, 10 pages, Aug. 2007.

International Search and Written Opinion mailed Jan. 18, 2011 for International Application No. PCT/US2010/001220.

International Search and Written Opinion mailed Jan. 26, 2011 for International Application No. PCT/US2010/001221.

China (CN Appl,. No. 201080017764.1) Office action, dated Jan. 4, 2013 along with an english translation thereof.

China (CN Appl,. No. 201080017726.6) Office action, dated Jan. 10, 2013 along with an english translation thereof.

Chinese Office Action in related Application No. 201080017726.6 dated Aug. 19, 2013 (with English-language translation).

Chinese Office Action in counterpart Application No. 201080017764.1 dated Aug. 19, 2013 (with English-language translation).

Chinese Office Action in counterpart Appl. No. CN 201080017764.1, dated Aug. 19, 2013 along with an english translation thereof.

Japanese Office Action in related Application No. 2012-507222, dated Dec. 6, 2013.

Chinese Office Action in related Application No. 201080017726.6, dated Jan. 3, 2014 (with English-language translation).

Chinese Office Action in related Application No. 201080017764.1, dated Nov. 15, 2013 (with English-language translation).

Chinese Office Action in counterpart Application No. 201080017726.6 dated Jun. 10, 2014 (with English-language translation).

Taiwanese Office Action in related Application No. 099112896 dated Oct. 8, 2014 (with partial English-language translation).

Taiwanese Office Action in related Application No. 099112897 dated Oct. 8, 2014 (with partial English-language translation).

Russian Office Action in related Application No. 2011147388 dated Sep. 10, 2014 (with English-language translation).

Japanese Office Action in related Application No. 2012-507221 dated Sep. 1, 2014.

Japanese Office Action in related Application No. 2012-507222 dated Sep. 1, 2014.

* cited by examiner

MULTI-FUNCTION CONDIMENT CONTAINER

This is a continuation-in-part of concurrently filed U.S. application Ser. No. 12/766,091 naming the same inventive entity. Both the concurrently filed application and the subject continuation-in-part application claim the benefit of the Apr. 23, 2009, filing date of Provisional Application No. 61/202,968.

BACKGROUND OF THE INVENTION

The present invention relates generally to packaging for condiments. More particularly, the present invention concerns condiment packaging adapted for opening in at least two different ways.

Condiment packaging has evolved over the years, starting with basic glass bottles and jars for display and sale of condiments, including without limitation ketchup, mustard, mayonnaise, sauces, and the like. That basic packaging later included larger capacity bottles and jars, and then containers made from synthetic plastic materials. Eventually, the packaging concepts turned to providing packaging suitable for individual portions of the condiments.

Individual packaging for condiments has, itself, seen changes. At one time, the packaging was simply an empty cup that could be filled with a condiment from a large capacity condiment dispenser that may, for example, have included a pump or other suitable dispensing device. For many years, condiments have been available in individual portion packets or sachets which seal the condiment between a pair of generally planar sheets of material. See, for example, U.S. Pat. No. 3,315,801. One or more weakened zone may be provided to simplify the act of opening the packet to access the condiment contained therein.

Condiment packages having a generally rectangular receptacle portion covered with a substantially planar sheet have been long known also. See, for example, U.S. Pat. No. 2,705,579. Such condiment packages were later provided with breakaway corners and exposed corners for the covering material, thereby providing different access means for the condiment packaged therein. See, for example, U.S. Patent Application Publication Nos. 2003/0183637, and 2002/0100760.

Packages for varied products are also known where the receptacle portion has a generally frustoconical shape with a spout at one side. See, for example, U.S. Pat. Nos. 2,898,003, 3,660,960, and 4,863,036. Typically, receptacles having this configuration have been used for relatively low viscosity products such as milk and cream.

Squeezable packages for products are also known where the package has a spout at one end and the forming materials are weakened in the vicinity of the spout to permit access to the contents thereof. See for example, U.S. Pat. Nos. 5,529,224, 4,921,137, and WO 2007/126817.

Containers for liquids have also been proposed which permit dual access modes. For example, one mode allowing squeezing for product removal and another mode allowing dipping for product removal. See, for example, U.S. Patent Application Publication No. 2006/0278562 (commonly owned, the entire contents of which are incorporated herein by this reference thereto). It has been proposed to use different opening methods where the product has different consistencies. See, for example, Fr. Patent No. 2,801,570. Moreover, various designs for containers which permit the varied kinds of access have also been disclosed. See, for example, U.S. Patent Application Publication No. 2007/0164045.

Notwithstanding the development of condiment containers, a number of difficulties are known to exist with available containers. More particularly, during use, the containers tend to be messy making them imperfect for use by children, and for use in vehicles when provided at drive-thru food sources. In addition, in recognition of environmental concerns, some retailers impose restrictions on the types of materials that may be used in products sold or otherwise provided through their retail outlets. When dealing with individual portion sizes of condiments, shelf-life stability for the condiments therein becomes important to maintain wholesomeness of the condiments. That stability may result from a variety of factors including for example permeability of container materials to oxygen.

Other shortcomings include difficulties encountered by a user when trying to insert his/her finger between a peelable cover and a flange of a container, when trying to peel-off the cover. The bonded relationship between the cover and the flange makes it difficult to properly grasp the cover.

Moreover, it is desirable to package condiment containers in closely arranged compact relationship for shipment, but the configuration of the containers often makes this difficult to achieve.

SUMMARY OF SELECTED ASPECTS OF THE INVENTION

For purposes of this invention, the word "condiment" should be interpreted broadly so as to include substances used to enhance larger food portions. Thus, as used in this application, "condiment" is intended to cover traditional condiments such as ketchup, mustard, mayonnaise, tartar sauce, and the like, as well as to encompass, without limitation, other comestibles such as sauces, jellies, jams, honey, and the like.

The improved condiment container according to this invention includes a cover portion and a container portion. The container portion preferably includes a receptacle proportioned to receive a predetermined volume of a condiment. Typically, the predetermined volume corresponds to the quantity of the condiment that a consumer may personally use during consumption of a meal.

Preferably, the receptacle of the container portion includes a generally planar bottom surface with a nominal length and a nominal width. The bottom surface provides a stable surface to support the condiment container during certain aspects of its use by a consumer. The receptacle also has a nominal depth selected in relation to the nominal width and nominal length to provide a receptacle that is low, wide, and stable against lateral tipping when a food item is thrust or poked into the receptacle.

The container portion preferably includes a flange extending substantially continuously around the receptacle. Preferably, the flange is generally planar, is spaced from the generally planar bottom surface, and parallel thereto. At one side of the receptacle and at the position of the flange, a spout is provided. The spout has cross-sectional area which is smaller than the cross-sectional area of the opening at the upper edge of the receptacle. In this manner, access to the condiment through the spout is much more restricted that access to the condiment through the upper edge of the receptacle.

Preferably, the container portion is fashioned from a material having a first bending stiffness sufficient that the receptacle retains its shape, even in the absence of the cover portion. Moreover, that first bending stiffness is also sufficient to ensure that the flange will retain its shape and orientation relative to the receptacle, even in the absence of the cover portion. To this end, container portion may be fabricated from a material selected from the group consisting of polyethylene terephthalate (PET), amorphous polyethylene terephthalate (APET), oriented polyethylene terephthalate (OPET), metalized polyethylene terephthalate (MET-PET), polyethylene (PE), low density polyethylene (LDPE), linear low density polyethylene (LLDPE), metalocene linear low density polyethylene (mLLDPE), high density polyethylene (HDPE), metalocene polyethylene (mPE), ethylene vinyl acetate (EVA), polypropylene (PP), metalized oriented polypropylene (mOPP), polystyrene (PS), high impact polystyrene (HIPS), foil, ethylene vinyl alcohol (EVOH), polyamide, Nylon, polyvinyl chloride (PVC), biaxially oriented materials, materials complying with 21 C.F.R. Part 177, and combinations thereof. While the container portion may comprise a single layer of material, the container portion may also be fabricated of multiple layers bonded, coextruded or otherwise formed together into a cohesive structure, where one or more of the layers is selected from the group of materials set forth above. Regardless of the particular composition used for the lid portion, all surfaces of the lid portion which face the receptacle are required to be food-safe.

The thickness of the container portion may preferably lie in the range of about 3 mils to about 20 mils—a mil being 0.001 inches. Depending upon the particular material and the thickness selected, it may also be desirable to further stiffen the bottom surface of the receptacle. Such stiffening may be accomplished by embossing a three-dimensional pattern into the bottom surface, thereby increasing its bending stiffness. A logo may be used to provide that three-dimensional pattern, if desired.

The cover portion is substantially planar and preferably is configured to have a perimeter substantially the same as the perimeter of the container portion. Moreover, the cover portion substantially covers the flange of the container portion. The cover portion, however, is preferably fabricated from a material having a second bending stiffness, where the bending stiffness of the cover portion is lower than the bending stiffness of the container portion. This difference in stiffness causes the cover portion to be more flexible and more readily separable from the container portion along the flange.

The material from which the cover portion is fabricated may be the same as, or different from, the material used for the container portion. Accordingly, the material of the cover portion may be selected from the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, materials complying with 21 C.F.R. Part 177, and combinations thereof. Typically, the thickness of the cover portion will lie in the range of about 1 mil to about 5 mils. While the cover portion may comprise a single layer of material, the cover portion may also be fabricated of multiple layers bonded, co-extruded or otherwise formed together into a cohesive structure, where one or more of the layers is selected from the group of materials set forth above. Regardless of the particular composition used for the lid portion, all surfaces of the lid portion which fact the receptacle are required to be food-safe.

To hold the cover portion and the container portion together in a condiment package, an adhesive is preferably positioned between the cover portion and the container portion, in the flange area, and surrounding the top edge of the receptacle. The adhesive preferably is a food-grade adhesive and may be conventionally cured, for example, thermally, electromagnetically, or time cured. Preferably, the adhesive is integral with the cover portion and/or the container portion. Application of heat and pressure can be used to cause the adhesive to bond the cover portion and/or the container portion. Alternatively, adhesive may be applied around the receptacle of the container portion in a separate step. Preferably the adhesive is applied such that the adhesive defines a non-bonded region in alignment with the spout, although the adhesive otherwise surrounds the spout. If desired, pressure may be applied to assure that the adhesive bonds the cover portion and the container portion so as to define a sealed compartment defined by the receptacle and the cover portion. Moreover, the adhesive is applied such that an non-bonded region exists between the lid portion and the flange of the container portion in general alignment with the spout.

Preferably, the non-bonded region is located opposite the spout and at the periphery of the container assembly. The non-bonded region is operable to define a lift tab at an edge of the lid portion. The lift tab is graspable so that it can be pulled away from the flange of the container portion so as to expose the receptacle and the contents thereof. Moreover, the adhesive is applied such that a peel-initiating region, such as a substantially angular region, partially defines an edge of the non-bonded region. The peel-initiating region is engaged as the lid portion is pulled by the tab from the container portion before the lid portion engages the full linear extent of the adhesive extending from side to side of the receptacle, and offers reduced resistance to separation between the lid portion and the container portion of the assembled package. For example, the required opening force may lie in the range of 1 to 5 lbs. Depending upon the opening scheme desired, the non-bonded region and the peel-initiator may be positioned in alignment with the spout or on the opposite side of the receptacle. Regardless of the position, when the lid portion is peeled back away from the container portion, the receptacle is exposed so as to be available for dipping a food item in the condiment.

Preferably, wherein at least one section of the flange in the non-bonded region is bent downwardly away from the cover portion to form therebetween a finger-access gap for facilitating manual gripping of the cover portion.

For access to the spout, a weakened area is preferably positioned so as to be transverse to the spout. The weakened area may be provided by mechanically cutting or fracturing the package materials in the vicinity of the spout. The weakened area may be fashioned by cutting the lid portion and the container portion so that a pair of aligned slits straddle the spout. Alternatively, the weakened area may be provided by laser scoring either the lid portion or the container portion or both. The end of the assembled container may then be broken away along the weakened area to expose the spout. By then squeezing the assembled container, the condiment will be released through the spout in a controlled manner.

In the assembled package, the adhesive preferably has sufficient strength that the container will resist bursting when subjected to a force of 50 lbs. or greater, and preferably when subject to a force of 70 lbs. or greater.

If desired, the container assembly may be adapted for attachment to the sidewall of a paperboard container. To this end, a pair of slits may be provided in the container and extending through both the lid portion and the container portion, where the slits are symmetrically disposed and cooperate to define a pair of ears. The ears can be bent out of the plane of the flange to define an angular (when viewed from the side) hook. Resilience of the materials used to fabricate the lid portion and the container portion cooperates to pinch an edge of the paperboard container. To further enhance the grip between the ears and an associated paperboard container, the surface of each ear may be suitable treated. For example, a tacky coating, or a roughened surface may be provided for such a purpose.

If desired, either or both of the lid portion and the container portion may include an oxygen control barrier or an oxygen scavenger layer. Such a barrier layer can be helpful to reduce or eliminate degradation of the condiment packaged in the container assembly. If desired, either or both of the lid portion and the container portion may be opaque. Opaqueness may enhance the packaged product where exposure to light degrades the product over time.

When the condiment packaged in the container is ketchup, the materials for the lid portion and the container portion are preferably selected such that the packaged condiment will have a shelf-life of at least about six months. One technique for evaluating shelf-life involves use of a colorimeter operating in the L*a*b* color space. Shelf-life may be evaluated by monitoring degradation of the color components of the packaged product according to measurements in that color space. For example, shelf-life may be determined by requiring that the L* and/or the ratio of a*/b* does not degrade more than a specified amount during the specified period, e.g., by less than 10% over a six-month period.

Preferably, at least one section of the flange in the non-bonded region between the cover and the flange is offset downwardly away from the cover portion to form therebetween a finger-access gap for facilitating manual gripping of the cover portion.

The sidewall preferably includes a front portion disposed below the spout at a location offset from a discharge end of the spout. An upper section of the sidewall front portion extends downwardly with respect to the spout and is configured to prevent the spout from being displaced upwardly in response to the upper section of the sidewall front portion being contacted by the rear portion of the flange of another container when a plurality of the containers is assembled in a package. That is preferably accomplished by orienting the upper section of the sidewall front portion substantially perpendicularly to the plane of the flange. Thus, a plurality of the containers can be disposed in partially overlapping relationship in a package or shipping container, with their spouts in alignment, and with a rear end of the flange of one container contacting the upper section of the sidewall front portion of an adjacent container, without causing the spout of that adjacent container from being displaced appreciably upwardly.

BRIEF DESCRIPTION OF THE DRAWINGS

Many objects and advantages of the present invention will be apparent to those skilled in the art when this written specification is read in conjunction with the appended drawings wherein like reference numerals are applied to like elements and wherein.

DETAILED DESCRIPTION OF THE PREFERRED EMBODIMENTS

Figure 1:
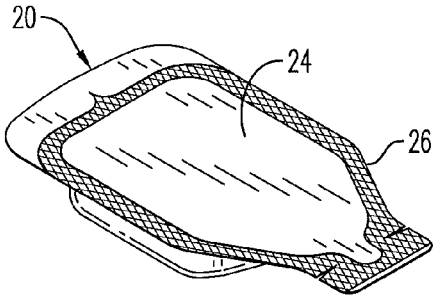
FIG. 1 is a perspective view of the condiment container.
Figure 2:
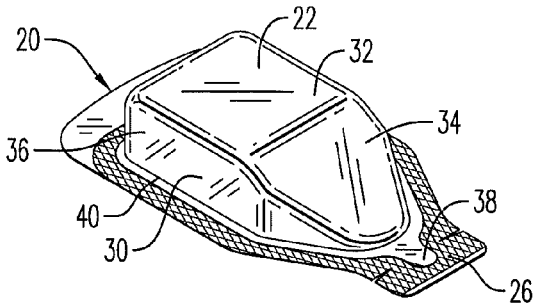
FIG. 2 is an inverted perspective view of a condiment container with the bottom surface positioned on top.

Turning now to FIG. 1 a first embodiment of the condiment container 20 according to this invention is adapted for marketing, and delivery to a consumer as an individual portion of a condiment. The condiment container 20 is formed by a container or cup portion 22 (see FIG. 2) and a lid or cover portion 24 (see FIG. 1) which are sealed together by an adhesive along a flange 26.

The lid portion 24 is preferably fabricated from a material selected from the group consisting of polyethylene terephthalate (PET), amorphous polyethylene terephthalate (APET), oriented polyethylene terephthalate (OPET), polyester (PE), low density polyester (LDPE), linear low density polyester (LLDPE), metalocene linear low density polyester (mLLDPE), high density polyester (HDPE), metalocene polyester (mPE), ethylene vinyl acetate (EVA), polypropylene (PP), high impact polystyrene (HIPS), foil, ethylene vinyl alcohol (EVOH), polyimide, Nylon, polyvinyl chloride (PVC), and combinations thereof. Where foil is used, that foil may be an aluminum foil, or other metal foil. Typically, the thickness of the lid portion 24 will lie in the range of about 1 mil to about 5 mils. More preferably, the lid portion 24 may have a thickness in the range of about 1 mil to about 3 mils. The thickness of the lid portion 24 is selected to be more flexible than the cup portion, to have sufficient tensile integrity that the lid portion 24 can be pulled away from the cup portion overcoming the tackiness of the adhesive, and to have a surface texture that is graspable but not too slippery. The lid portion 24 preferably has a peripheral contour that substantially corresponds to the perimeter of the flange 26.

While the lid portion 24 may comprise a single layer of the selected material, the lid portion 24 may also be fabricated of multiple layers bonded, co-extruded or otherwise formed together into a cohesive structure, where one or more of the layers is selected from the group of materials set forth above. Regardless of the particular composition used for the lid portion 24, all surfaces of the lid portion 24 which face the packaged condiment are required to be food-safe. If the condiment to be packaged experiences oxygen degradation over time, the lid portion 24 may include an oxygen control layer or an oxygen scavenger layer in its structure. One suitable material for an oxygen control layer is EVOH which can function not only as an oxygen barrier but may also function as a moisture barrier. Depending on the condiment, the material from which the lid portion 24 is fabricated may be transparent, translucent, or opaque. Moreover the material may be colored, if desired.

While the combinations of acceptable material combinations for the lid portion 24 is large, the following table identifies some combinations known to be useful for the lid stock.

TABLE 1

| Lid Stock Structures |
|---|
| PET/foil/LDPE-based sealant |
| PET/foil/EVA-based sealant |
| PET/LDPE-based sealant |
| OPET/PE/foil/LDPE/mLLDPE |
| OPET/PE/foil/PE/mLLDPE |
| Metalocene PE |
| EVA |
| PET/MET-PET/EVA-based sealant |

Figure 5:
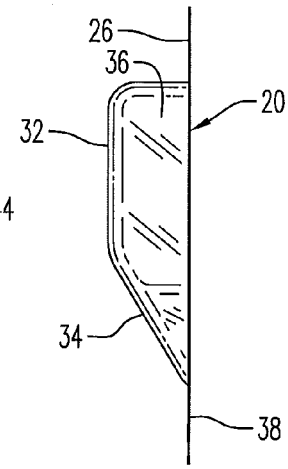
FIG. 5 is a top plan view of the condiment container.
Figure 6:
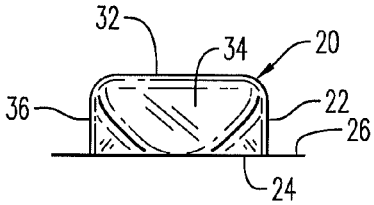
FIG. 6 is an end elevational view of the condiment container.

The cup portion 22 (see FIG. 2) includes a receptacle 30 which extends away from the flange 26 and includes a generally planar bottom surface 32 which may be generally rectangular. In addition, the receptacle 30 includes a sidewall 36 extending between the bottom surface 32 and the flange 26. The flange 26 extends generally radially from the edge 40 (see FIG. 2) and defines a substantial area which is exposed until the lid portion 24 is applied. In addition, one side of the receptacle may include a generally triangular or generally trapezoidal surface 34 which is inclined relative to the generally planar flange 26 and the bottom surface 32. At one side of the receptacle 30 a spout 38 is provided. Preferably, the cup portion 22 is designed so as to be symmetrical about a longitudinal plane extending perpendicularly to the plane of FIG. 5 and generally coincident with the line 9-9.

Figure 4:
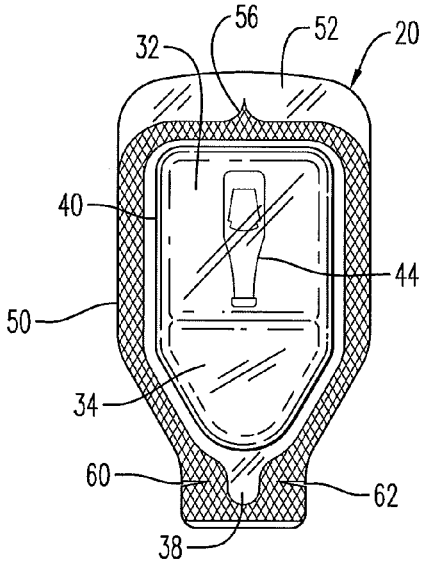
FIG. 4 is a side elevational view of the condiment container.

When the lid portion 24 is in place, that symmetry of the cup portion 22 coupled with the inclined surface 34 and the lid portion 24 creates a funnel or converging cross-sectional area at the side of the receptacle so that the funnel communicates with the spout 38. Thus, the spout 38 exhibits a cross-sectional area that is much smaller than the area exposed at the top edge of the receptacle 34 (see FIG. 4).

The cup portion 22 (see FIG. 3) is preferably fabricated from a material that is more rigid than the stock from which the lid portion is made. Thus, the bending stiffness of the cup portion 22 exceeds the bending stiffness of the lid portion 24. That difference in stiffness makes the lid portion more readily deform for removal and opening of the assembled container. Although the cup portion 22 is stiffer than the lid portion 24, the cup portion 22 preferably is sufficiently pliable that it can be deflected by squeezing with hand pressure—i.e., pressure applied by fingers of an unaided human hand. Nevertheless, the cup portion 22 is sufficiently stiff that it does not deform or deflect in the absence of force. With those constraints and in the absence of the lid portion 24, the cup portion 22 can be supported by the bottom surface to provide a sufficiently rigid container to hold a condiment without spilling. In this connection, the generally planar flange 26 extending outwardly from the perimeter 40 of the receptacle also functions to stiffen the receptacle region of the cup portion 22.

In some applications, it may be desirable to have a bottom surface 32 (see FIG. 4) having increased stiffness. Such an increased stiffness may be accomplished by providing an embossed feature 44 in the bottom surface 32. Such an embossed feature 44 may also extend onto the inclined surface 34, if desired. In some applications, that embossed feature 44 may comprise a logo of the manufacturer. The enhanced stiffness results from the depth of the embossed feature 44 relative to the plane of the bottom surface 32.

In general, the material from which the cup portion 22 is fabricated may be selected from the same group of materials available for the lid portion 24, namely the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, materials complying with 21 C.F.R. Part 177, and combinations thereof. Where foil is used, that foil may be an aluminum foil, or other metal foil. Typically, the thickness of the cup portion 22 will lie in the range of about 3 mils to about 20 mils. More preferably, the cup portion 22 may have a thickness in the range of about 8 mils to about 12 mils. The thickness of the cup portion 22 is selected to be less flexible than the lid portion 24 so that the lid portion 24 can be pulled away from the cup portion 22 overcoming the tackiness of the adhesive.

As with the lid portion 24, certain combinations of the materials for the cup portion 22 have been found to be particularly suitable, as set forth in the table below.

TABLE 2

| Suitable Cup Portion Material Combinations |
|---|
| PVC/adhesive layer/sealant film |
| APET/adhesive layer/sealant film |
| APET/sealant film |
| PP/adhesive layer/sealant film |

TABLE 2-continued

| Suitable Cup Portion Material Combinations |
|---|
| HIPS |
| APET/EVOH |
| APET/PE/EVOH/PE |
| APET/HDPE/EVOH/LDPE |
| APET/Nylon/APET |
| APET/Nylon/EVOH |
| PS/EVA/EVOH/EVA/sealant |

Figure 3:
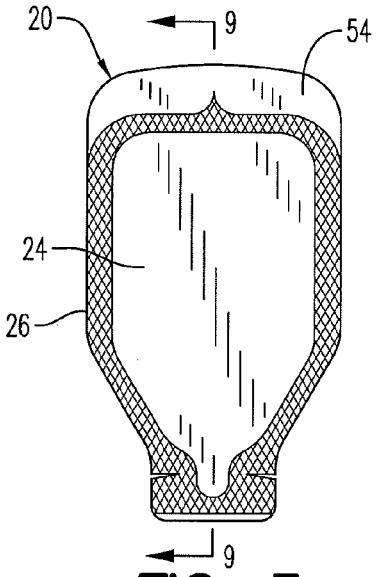
FIG. 3 is a bottom plan view of the condiment container.

The receptacle of the condiment container 20 is preferably sized to contain a suitable individual serving of the condiment, for example, a nominal volume of about one ounce. While larger and smaller nominal volumes are within the scope of this invention, the nominal volume will generally correspond to the quantity of the particular condiment desired by a typical individual. As seen in FIG. 3, the receptacle portion of the package has a nominal width corresponding to the maximum distance between the opposed sidewalls at the location of the edge 40 and extending transverse to the plane of symmetry between opposed sidewalls, a nominal length being the maximum length between sidewalls of the receptacle at the location of the edge 40 and measured along the plane of symmetry, and a nominal depth (see FIG. 4) also measured in the plane of symmetry but extending from the bottom surface 32 to the flange 26. These nominal dimensions define the nominal volumetric capacity for the receptacle portion.

Another important feature of the cup portion 22 is lateral stability against tipping. Furthermore these nominal dimensions can be used to establish guidelines that provide adequate tipping stability. More specifically, the ratio of the nominal height to the nominal width is preferably less that about 0.5, and more preferably less than about 0.45. In addition, the ratio of the nominal height to the nominal length is preferably less that about 0.3, and more preferably less than about 0.26. When the receptacle of the cup portion 22 has nominal dimensions within these ranges, the receptacle is sufficiently stable that it does not tip when a food item is dipped in the condiment contained therein.

The lid portion 24 and the cup portion 22 are sealed together using a food-grade adhesive so as to define an encapsulated volume isolated from the environment. One technique for accomplishing the seal is to include a heat-sealable layer on the inside of the lid portion 24 and on the inside of the cup portion 22. Upon application of heat and pressure applied to the flange 26, the adjacent surfaces bond together forming the appropriate seal surrounding the periphery of the edge 40 of the receptacle. Alternatively, a suitable food-grade adhesive compatible with the materials of the container may be used. The adhesive is preferably applied so as to surround the edge 40 of the receptacle (see FIG. 3), but not so at to be contiguous therewith—i.e., some space exists between the adhesive and the edge 40. Moreover, the adhesive is applied so that it does not cover the spout 38. Preferably, the condiment container is capable of withstanding an applied force of at least about 50 lbs without bursting or breaking through the seal. More preferably, an applied force of about 70 lbs. will not burst the seal.

The adhesive preferably extends to the peripheral edge 50 of the flange 26, but provides an non-bonded region 52 at one side of the receptacle. That non-bonded region 52 extends inwardly along the flange 26 from the peripheral edge 50 of the flange by a distance sufficient that a pull-tab portion 54 (see FIG. 5) of the lid portion 24 not adhesively connected to the flange 26 is sufficiently large to be graspable between fingers. A distance of about 0.5 inches or more is graspable for the pull-tab 54. It will be apparent to those skilled in the art that attempting to peel a lid portion away from the flange 26 (see FIG. 3) is difficult due to the width of the seal. It has been found, however, that inclusion of a generally angular feature 56 aligned with the plane of symmetry and defining part of one edge of the non-bonded region 52 provides a peel-initiator that reduces the necessary force to peel the lid portion away from the flange 26. Inclusion of a peel-initiator at the edge of the non-bonded region materially enhances the ease with which the lid portion can be removed from the container.

From the foregoing discussion, it will be apparent to those skilled in the art that the tab 54 can be grasped to pull the lid portion 24 away from the flange 26 of the cup portion 22 to expose the receptacle and its contents. Such a step would prepare the container for dipping a food item into the condiment. However, a different opening scheme is also available with the container of this invention. More particularly, the container may be provided with a weakened region in the vicinity of the spout 38 for the purpose of opening the spout 38 as an alternative to removal of the lid portion 24. The weakened region may, for example, comprise a pair of aligned slits 60, 62 in the vicinity of the spout 38. The slits 60, 62 are aligned with one another and straddle the spout 38. The slits 60, 62 may extend through the thickness of both the lid portion 24 and the cup portion 22. With this arrangement, the distal end of the container 20 can be bent to fracture the material of the container and expose a channel through the spout 38 into the receptacle. At that point application of pressure to the receptacle will cause the condiment to be expelled through the spout 38 in directionally controlled and defined way.

The aligned slits 60, 62 can be applied to the container before, during, or after assembly of the condiment container 20. However, an efficient mechanical way of creating the aligned slits 60, 62 is to form them at the same time that the lid portion 24 is applied to the cup portion 22 and adhesively connected thereto. Alternatively, a laser scoring process may be employed to weaken the container around the spout 38 so that an end of the container can be snapped or twisted off to expose the end of the spout passage.

The materials selected for the lid portion 24, the cup portion 22, and the adhesive are preferably chosen so that the condiment has a desired shelf life. In the case of a condiment such as ketchup, a shelf-life of at least six months is desirable. With condiments like ketchup, shelf-life can be evaluated by changes in the color characteristics of the condiment. Testing for shelf-life can, therefore, be conducted using colorimetric analyses. The Hunter Lab color space and the L*a*b* color space use three coordinates to define any particular color. For example, in the L*a*b* color space, the coordinates L*, a*, and b* define the three-dimensional color space. The L* component measures lightness and correlates particularly well with human eye perceptions. The L* value ranges between 0 corresponding to pure black and 100 corresponding to pure white. The a* coordinate measures the color position between red/magenta and green, with negative values indicating green and positive values indicating magenta. The b* component measures the color position between yellow and blue, with negative values indicating blue, while positive values indicate yellow. Accordingly, changes in ketchup color over time can be evaluated by the value of and changes in the value of the L*, a*, and b*, or L, a, b components. For purposes of shelf-life analysis, it has been found that the lightness component, L* or L, provides a reliable parameter to correlate with shelf-life. More particularly, as long as the L* component value remains within about 10% of its initial value, during the shelf-life, the shelf-life requirement is satisfied. In addition, the ratio of a*/b* or a/b is also indicative of product degradation. Thus, in some instances, satisfactory shelf-life may be determined when the L* (or L) component and the a*/b* (or a/b) ratio remain within about 10% of their initial values, respectively. Other condiments for which color changes over time can also be colorimetrically evaluated for shelf-life using one or more of the L*a*b* color space components.

Figure 7:
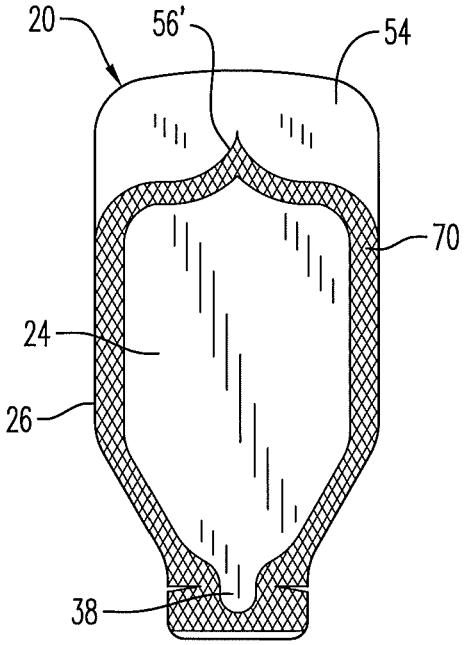
FIG. 7 is a top plan view of a second embodiment of the condiment container.

An alternative embodiment of the invention is shown in FIG. 7. In this arrangement, the peel initiator 56' and the adjacent seal portion are constructed such that the peel-initiator blends to a seal presenting a gradually increasing resistance, as opposed to the step-wise increasing resistance of the first embodiment. This arrangement is characterized by the angularly converging portions of the seal that terminates with the peel-initiator 56'.

Figure 8:
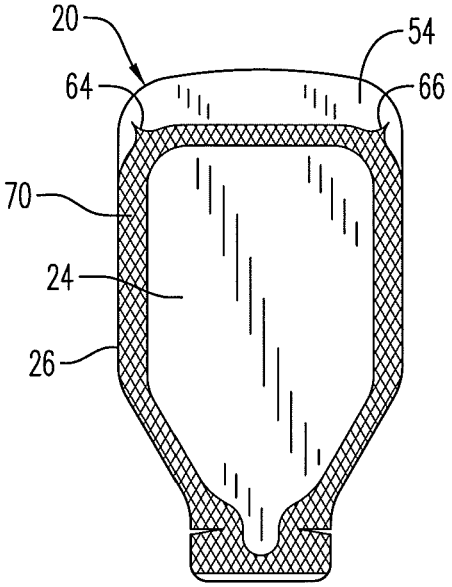
FIG. 8 is a top plan view of a third embodiment of the condiment container.

Yet another embodiment of the invention includes a pair of peel-initiator structures in the adhesive bonding between the lid portion 24 and the cup portion (see FIG. 8). In this arrangement, a peel initiator 64, 66 is provided at corresponding corners of the adhesive seal. With this arrangement, the lid portion 24 may be peeled away from either corner with a corresponding reduction in the force needed to initiate the peel-away.

Figure 9:
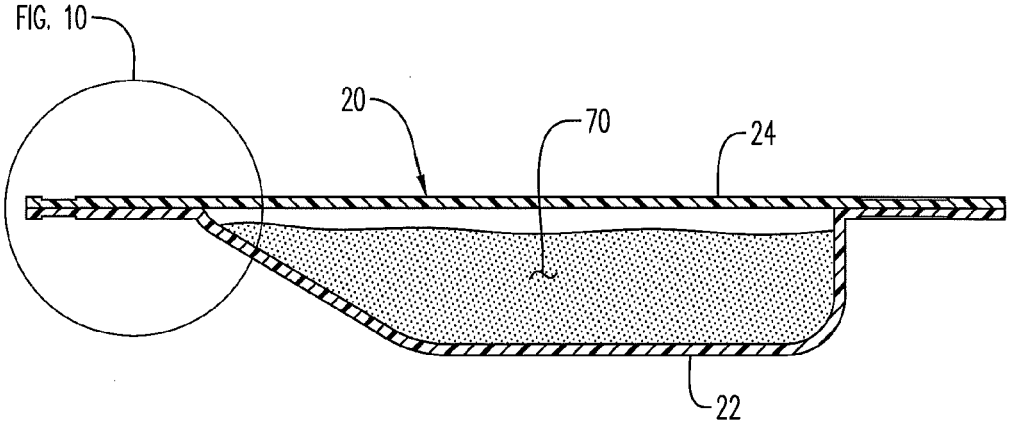
FIG. 9 is an enlarged cross-sectional view taken along the line 9-9 of FIG. 5.
Figure 10:
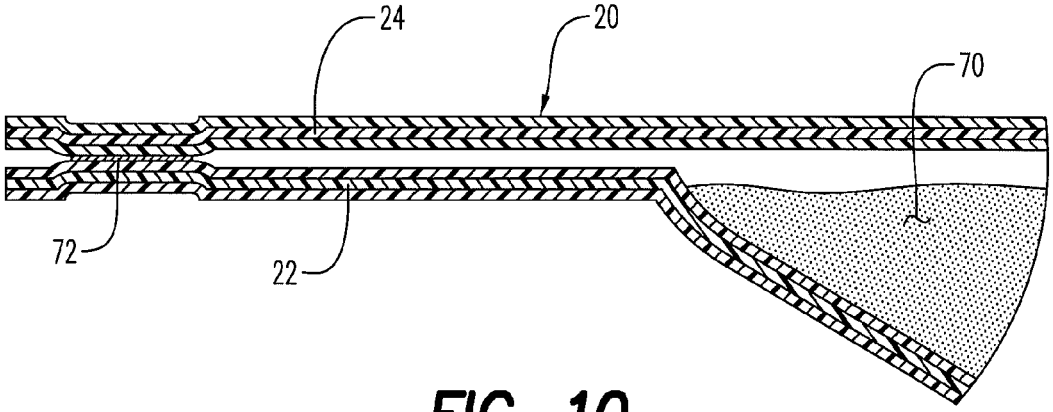
FIG. 10 is an enlarged detail view of spout end encircled FIG. 9.

To assemble the condiment container 20, the cup portion 22 may be exposed to a dispensing mechanism that deposits a metered volume of condiment 70 (see FIG. 9) in the receptacle. The metered volume supplied is less than the actual volume of the receptacle so that some head space exists above the condiment. After the adhesive is applied to the flange 26, the lid portion 24 is positioned in overlying relationship to the cup portion 22 and sealed thereto. The resulting structure includes an adhesive 72 bonding the lid portion 24 and the cup portion 22 (see FIG. 10).

In another embodiment of the condiment container 20 (see FIG. 7), the non-bonded region 54 may be enlarged insofar as its width in the direction of the plane of symmetry is concerned. Other than the peel-initiator 56' and associated structure, the condiment container 20 of this embodiment has the same features and characteristics as the embodiment described above in connection with FIGS. 1-6. Accordingly, those common features will not be repeated here. The peel-initiator 56' of this second embodiment extends farther into the region 54 than in the first embodiment while the adhesive seal 70 has a substantially uniform width around the edge of the receptacle. Here, the peel-initiator 56' is shaped substantially as a chevron, caret, or curly bracket. Moreover, the peel-initiator 56' is positioned in general longitudinal alignment with the spout 38 but is located on the opposite side of the receptacle from the spout 38. With such an arrangement, the alternative structures for opening the package are separated from one another so that the user or consumer makes a conscious decision as to whether to open the condiment container by breaking or tearing open the spout 38 for a squeeze application, or to peel back the lid portion 24 so that the container 20 can be used for a dipping application.

In a further embodiment (see FIG. 8), the condiment container 20 has a different position and arrangement for the peel-initiator but is otherwise fully described by the discussion above in connection with FIGS. 1-6, which discussion will not be repeated here. In this further embodiment, a pair of peel-initiators 64, 66 are provided, and each peel-initiator 64, 66 is positioned at a corresponding corner of adhesive seal 70 generally aligned with a corner of the receptacle. Recognizing that some consumers may find it easier, or more intuitive to start peeling back the lid portion 24 from a corner, the corner location of the peel initiators 64, 66 facilitates the peel opening. As shown, the peel-initiators 64, 66 are symmetric with respect to the plane of symmetry for the condiment container so that either corner may be randomly chosen by the consumer or user to start the peel opening process.

It is also within the purview of this disclosure that only one peel-initiator be used and that that peel-initiator be located at a corner of the condiment container offset from the plane of symmetry. Such a container may look like the embodiment of FIG. 8 but with only one of the peel-initiators 64, 66 being present. It is likely that with such an embodiment directions might be provided on the outside surface of the lid portion 24 focusing consumer attention on the appropriate corner for peel initiation. Alternatively, the cup portion 22 and the lid portion 24 could be trimmed more closely to the adhesive line at one corner, leaving a tab projecting from the other corner and the peel-initiator so that peel-type opening would necessarily occur at the peel-initiator, whether it is centrally positioned or arranged at that other corner of the container. Here again, the features of such a condiment container are adequately described above in connection with FIGS. 1-6 and will not be repeated here.

Figure 11:
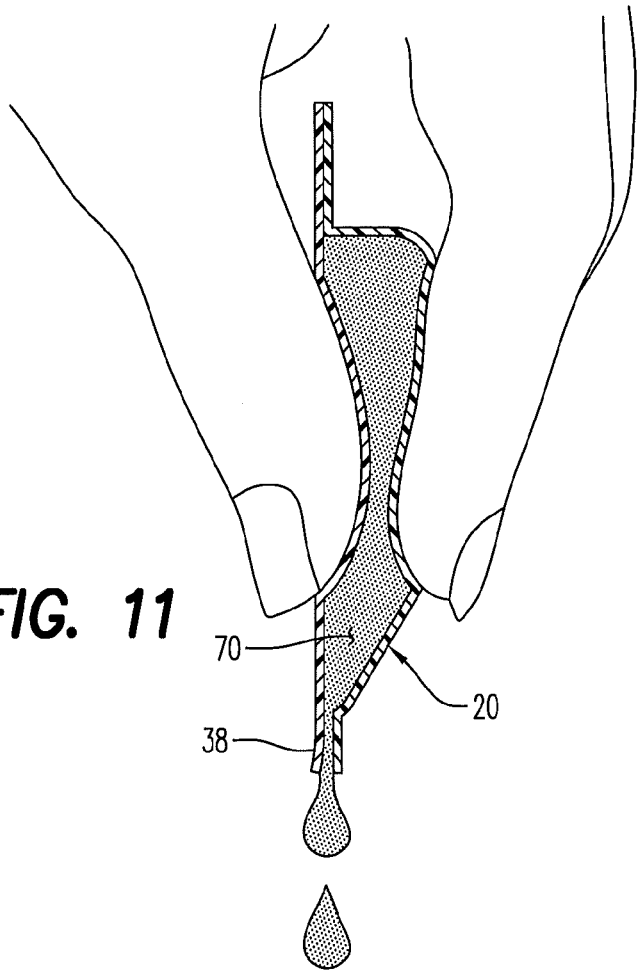
FIG. 11 depicts the condiment container opened for squeeze application.
Figure 12:
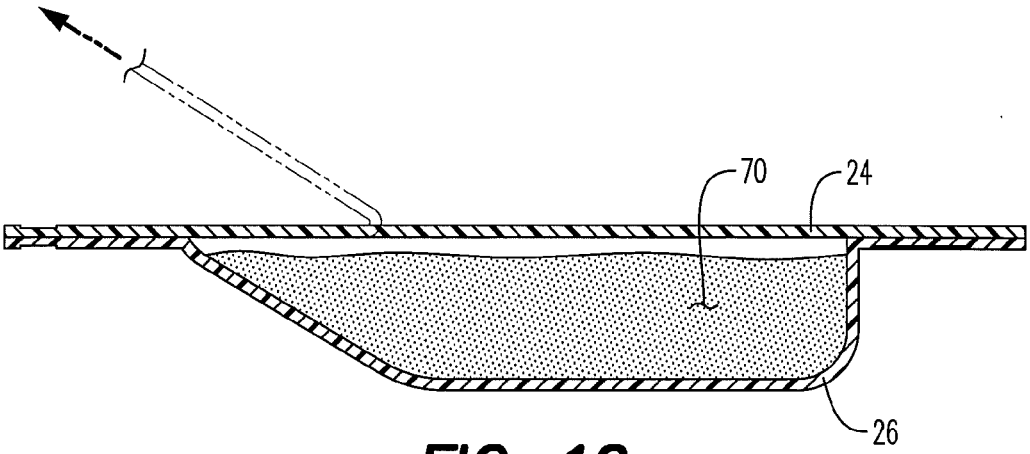
FIG. 12 is a cross-sectional view of the condiment container of FIG. 1 showing access for dipping.

To use the condiment container 20, (see FIG. 11), the consumer initially decides whether to have controlled dispensing of the condiment or to have full access to the receptacle. Where controlled dispensing is desired, the end of the container is broken off or twisted off at the location of the weakened area to expose the end of the spout 38. By applying finger pressure to the receptacle area, condiment is squeezed out of the spout so that it can be applied selectively, directionally, and in a controlled manner to a food item. Where fuller access to the condiment is desired (see FIG. 12), the tab 54 may be pulled away from the flange, past the peel-initiator, and away from the upper edge of the receptacle to expose as much (or all) of the receptacle as may be desired.

Figure 13:
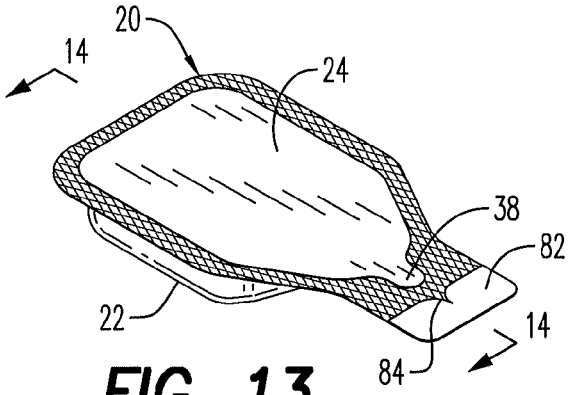
FIG. 13 is a perspective view of a fourth embodiment of the condiment container viewed from the top.
Figure 15:
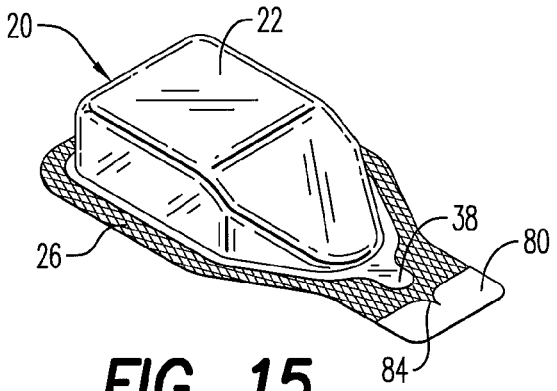
FIG. 15 is a perspective view of the fourth embodiment of the condiment container.
Figure 14:
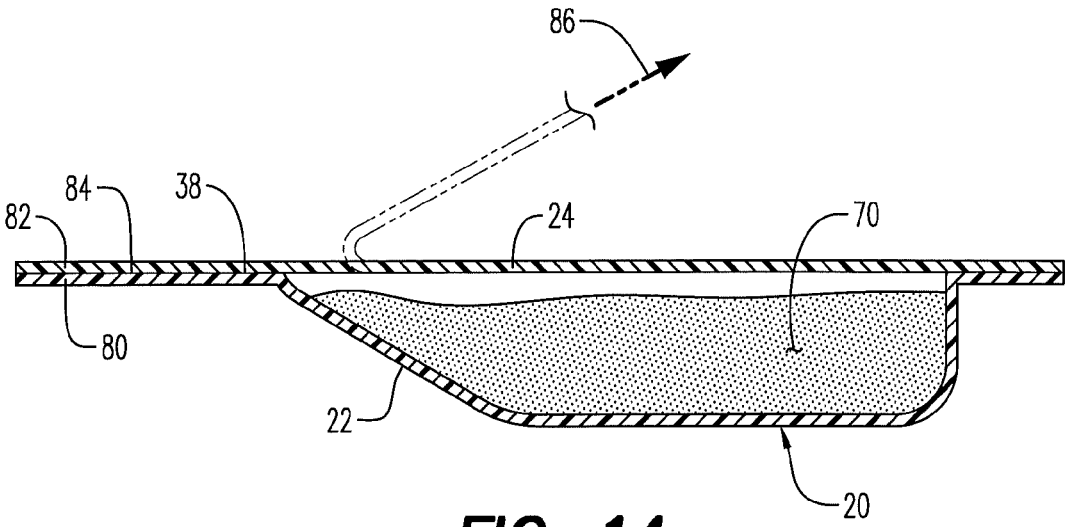
FIG. 14 is a cross-sectional view of the fourth embodiment of the condiment container taken along the line 14-14 of FIG. 13.

Yet another embodiment of the condiment container 20 (see FIG. 13) has a different position for the peel-initiator 84. The features of this condiment container not specifically described are adequately described in connection with FIGS. 1-6 and will not be repeated here. In this arrangement, the peel initiator 84 is aligned with the spout 38 and positioned so that the spout 38 is between the peel initiator 84 and the receptacle of the cup portion 22 (see FIG. 14). Here, the flange 26 of the cup portion 22 includes a tongue 80, which may be generally rectangular, symmetrically disposed with respect to the spout 38 and extending beyond the spout. The peel-initiator 84 may have a generally angular or generally pointed feature oriented outwardly away from the spout 38 and the receptacle, but in general alignment therewith. Preferably, the tongue 80 extends beyond the peel-initiator 84 by a distance of 0.5 inches or more. The lid portion 24 (see FIG. 13) also includes a tongue 82 adapted, sized, and arranged to overlie and conform to the tongue 80 of the cup portion.

To open the condiment container 20, the tongue 86 of the lid portion 22 (see FIG. 14) is grasped and peeled away from the tongue 80 of the cup portion 22, for example in the direction of arrow 86. After the separation begins at the peel-initiator 84, the tongue 82 of the lid portion 22 exposes the end of the spout 38. At this point, the condiment container 20 may be squeezed by the user so that condiment is expressed through spout 38 in a controlled and readily directed manner. Rather than stopping when the spout is exposed, the lid portion 24 may be peeled farther away from the tongue 80 of the cup portion 22 to expose a portion or all of the receptacle and the condiment 70 therein. Thus, the container 20 can provide a dipping container for a food item. It will be apparent to those skilled in the art that it is not required that the lid portion either open the spout or open the receptacle. If desired, the consumer may first open the spout and dispense some of the condiment therethrough, and later open the lid portion to expose the receptacle to use some of the condiment by dipping. Moreover, if desired, the lid portion may be partially opened or completely removed.

Figure 16:
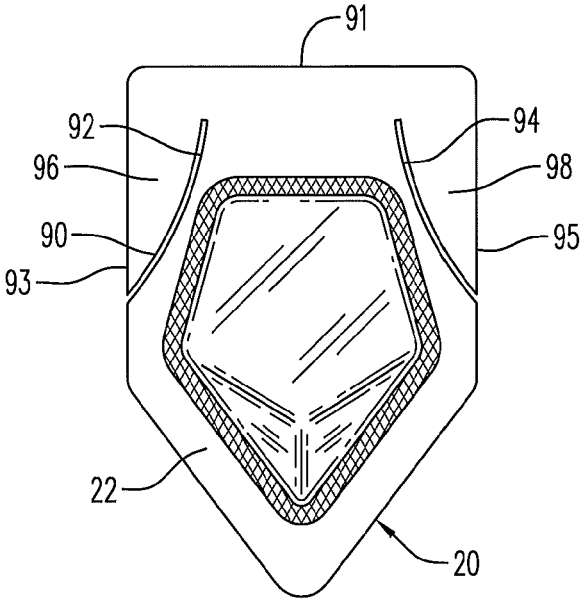
FIG. 16 is a top plan view of a fifth embodiment of the condiment container.
Figure 17:
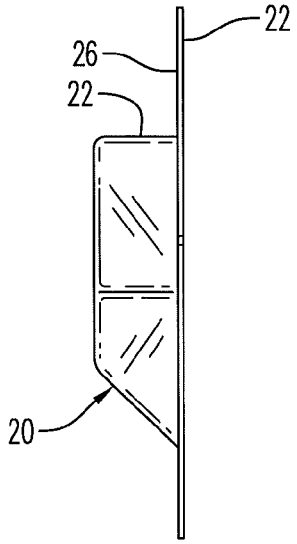
FIG. 17 is a side elevational view of the fifth embodiment of the condiment container.

Another embodiment of the condiment container 20 (see FIG. 16) may have the spout 38 located at one end with the graspable tongue extending in a generally triangular configuration beyond the spout 38. The features of this condiment container not specifically described are adequately described in connection with FIGS. 1-6 and will not be repeated here. This embodiment also includes a generally pentagonal receptacle 90, but with sides meeting at obtuse angles. One end of the container has a generally straight edge 91 extending generally perpendicularly to the plane of symmetry for the container 20, and having a length corresponding to the maximum width of the container 20. The container also includes side edges 93, 95 extending from corresponding ends of the straight edge 91 to corresponding corners of the container. A pair of symmetrically disposed slits 92, 94 extend from the corresponding side edge 93, 95 toward the straight edge 91, but do not intersect that straight edge 91. The slits 92, 94 may be straight or arcuate, as desired, but the blind end of each slit 92, 94 is spaced from the straight edge 91 as well as from both side edges 93, 95. With that arrangement, the slits 92, 94, and the side edges 93, 95 cooperate to define a pair of symmetrically disposed ears 96, 98. At the time of manufacture, the ears 96, 98 lie in the plane of the flange 26 (see FIG. 17).

Figure 18:
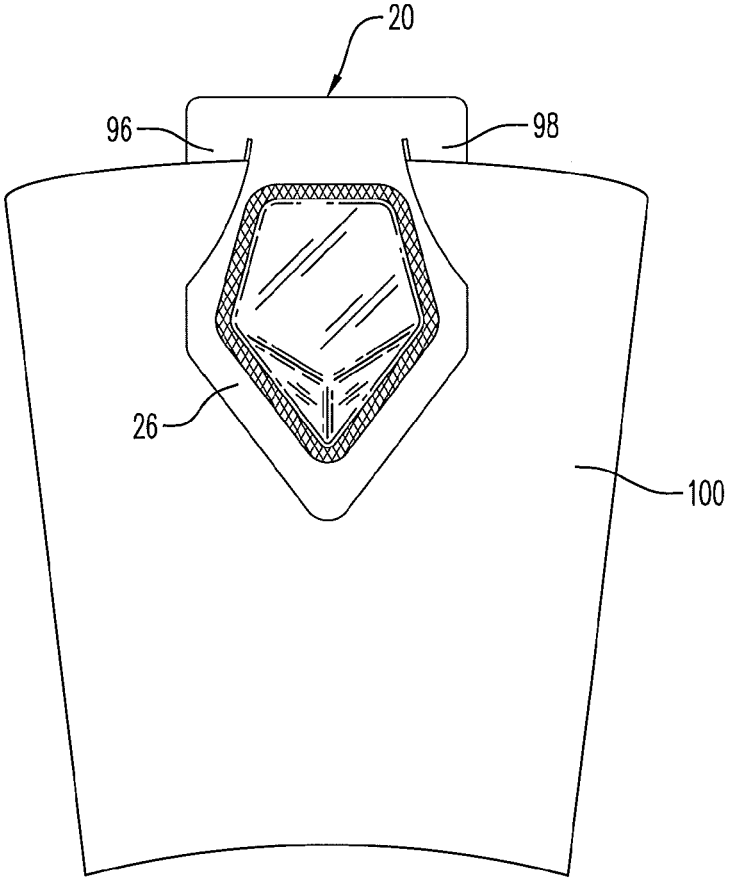
FIG. 18 depicts use of the fifth embodiment in conjunction with a food container.
Figure 19:
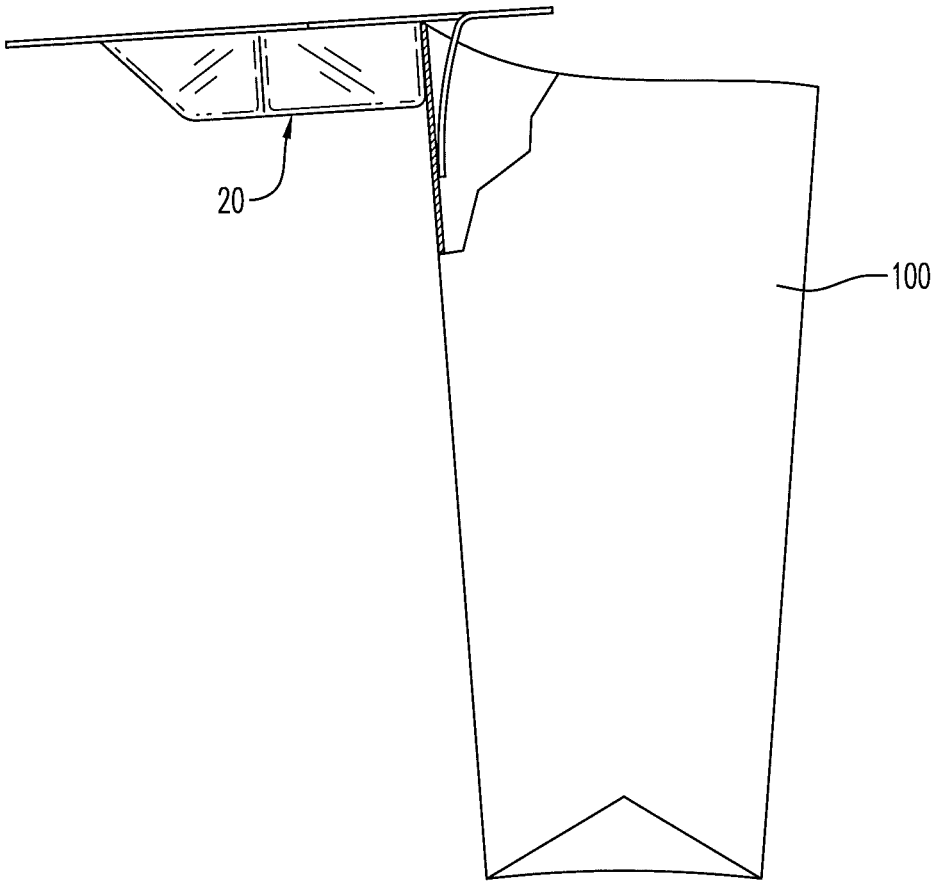
FIG. 19 is a side elevational view of FIG. 18.
Figure 20:
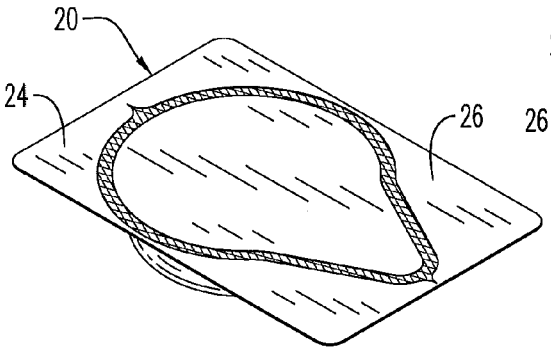
FIG. 20 is a perspective view of the sixth embodiment of the condiment container.

In use, the condiment container 20 of this embodiment provides an additional convenience feature (see FIG. 18). The ears 96, 98 may be pushed out of the plane of the flange 26 so that an upper edge of a package 100 can be received between the ears 96, 98 and the flange 26. In this fashion, the condiment package 20 can be dispensed with the package 100 where appropriate. The condiment container 20 can be configured for opening a described above in any of the other embodiments. Moreover, when opened for dipping use (see FIG. 19), the cooperation between the ears 96, 98 and the side of the package 100 will support the condiment container 20 in cantilevered position so that the condiment is readily accessible.

If desired, the surface of each ear 96, 98 may be treated to enhance frictional engagement with a package 100. For example, the surface of the ears 96, 98 could be roughened relative to other surfaces of the container 20, or may have a low tack adhesive applied to at least a portion thereof.

Figure 21:
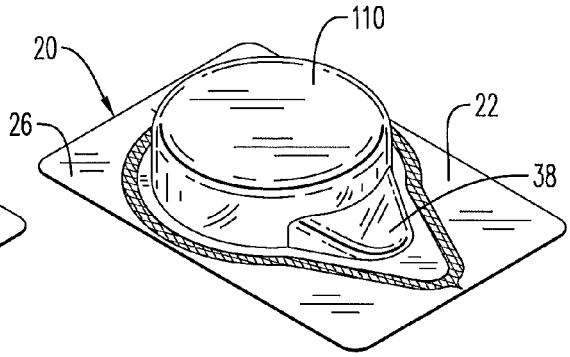
FIG. 21 is an inverted perspective view of a sixth embodiment of the condiment container.
Figure 22:
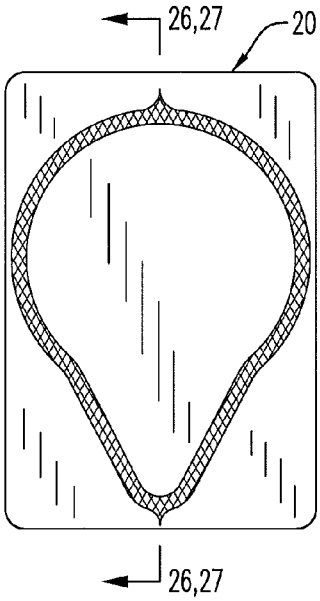
FIG. 22 is a top plan view of the sixth embodiment.
Figure 23:
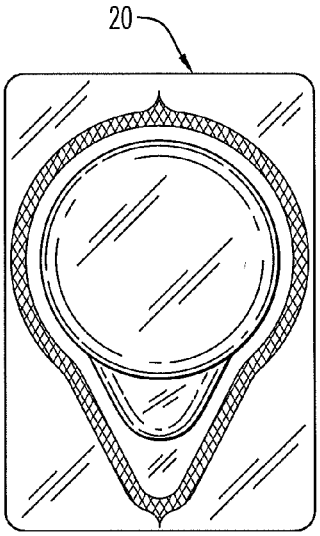
FIG. 23 is a bottom plan view of the sixth embodiment.
Figure 24:
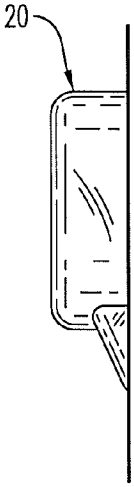
FIG. 24 is a side elevational view of the sixth embodiment.
Figure 25:
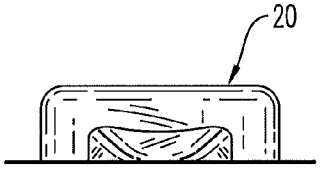
FIG. 25 is an end elevational view of the sixth embodiment.
Figure 26:
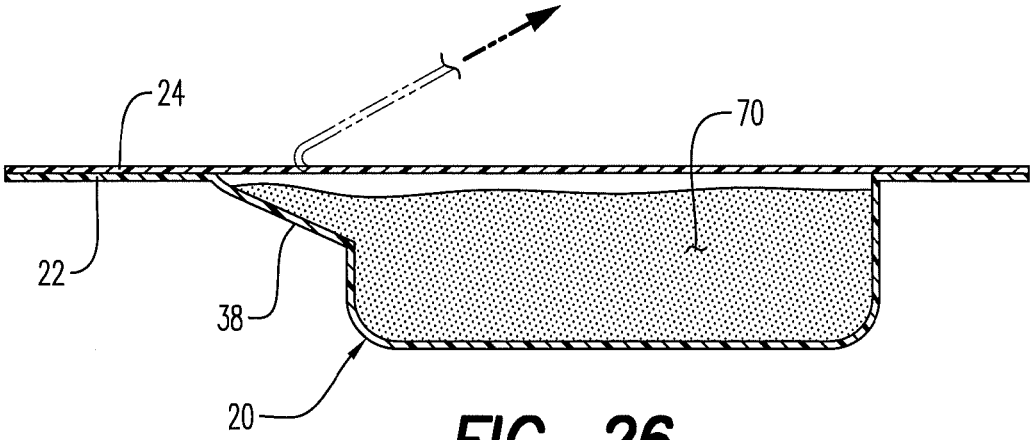
FIG. 26 is a cross-sectional view of the sixth embodiment showing opening and access to the spout for squeezing.
Figure 27:
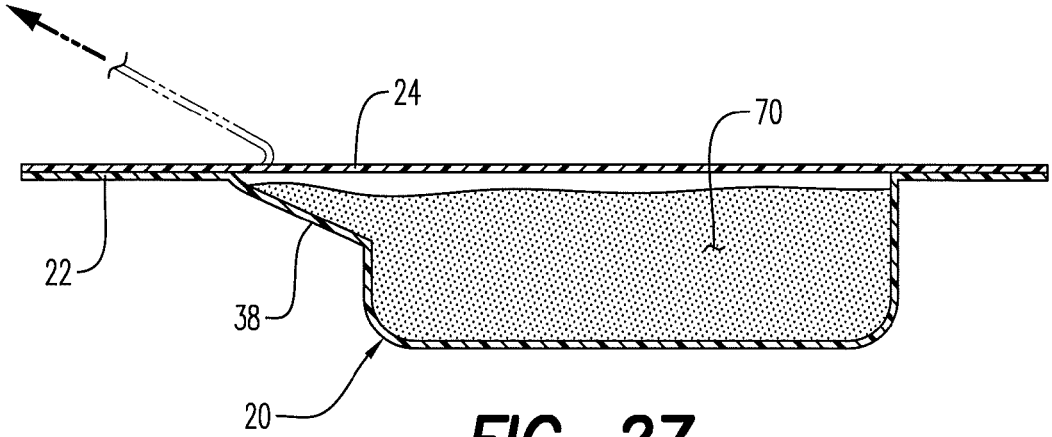
FIG. 27 is a cross-sectional view of the sixth embodiment showing opening and access for dipping.
Figure 28:
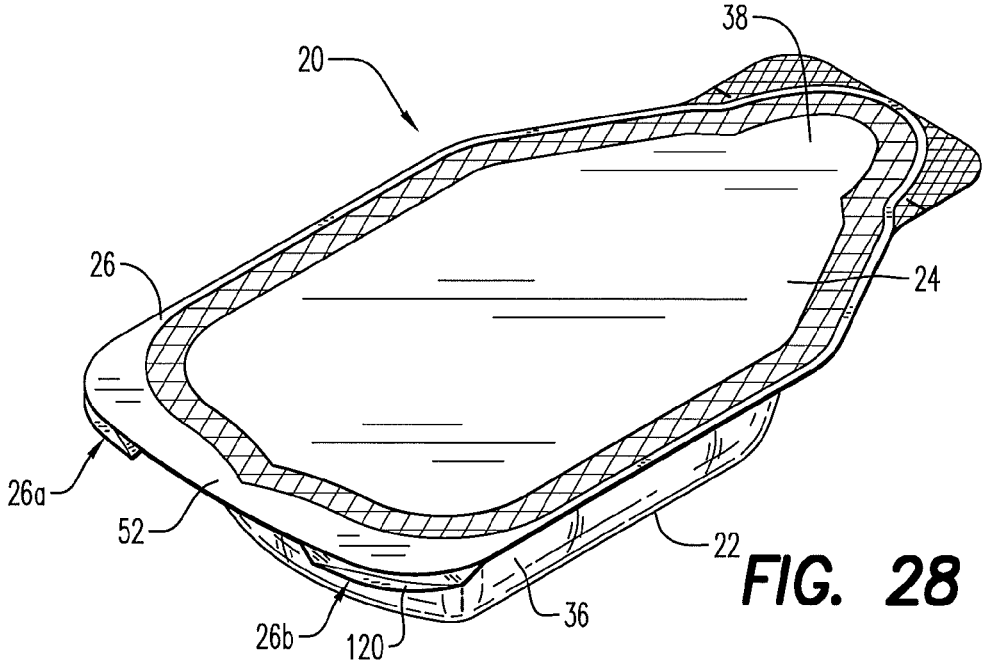
FIG. 28 is a top, rear perspective view of a seventh embodiment of the condiment container.

The shape of the receptacle in the cup portion may be generally pentagonal as depicted in the embodiments described above, but may also have other desired shapes. For example, generally rectangular, generally square, generally triangular, generally polygonal, oblong, generally elliptical, and other shapes for the receptacle are all within the scope of this disclosure. For example, another embodiment of the condiment container 20 may include a generally cylindrical receptacle 110 (see FIG. 4A). The features of this condiment container not specifically described are adequately described in connection with FIGS. 1-6 and will not be repeated here. As seen from the various embodiments shown and described in this disclosure, the flange 26 surrounding the receptacle may follow the shape of the upper edge of the receptacle, or may have a larger area. In FIG. 21, for example, the flange 26 is generally rectangular thereby providing multiple locations from which the lid portion can be peeled back, some of which access the spout and some of which access the receptacle.

To make a container in accordance with this disclosure, the material for the cup portion is typically provided in a roll. That roll of material is unwound into a forming device as a substantially continuous sheet where a plurality of receptacles are formed. Typically, the receptacles may be formed in a row having two to about twelve or more receptacles therein, thereby forming a sheet with receptacles in straight transverse rows and straight longitudinally extending rows running in the direction of the length of the sheet unwound from the roll.

The sheet with formed receptacles then advances to filling apparatus. In that filling apparatus, the desired condiment is deposited in the receptacles through a conventional metering device to control the quantity and volume of condiment for each receptacle. Ordinarily, there is a filling head for each longitudinal row of receptacles in the sheet. Moreover, these filling heads may supply the same condiment in each of the longitudinal rows. However, if desired, it is within the scope of this disclosure that adjacent fill heads may deliver different condiments so that different condiments are filled in the receptacles of adjacent longitudinal rows of the sheet.

Next, the sheet with filled receptacles is flushed with gas compatible with the product and helpful in retarding product degradation. At this point a second sheet of material for the lid portion is unrolled and advanced into overlying relationship with the receptacle sheet where it is sealed into position with respect to each of the receptacles.

The filled, covered, receptacles in the substantially continuous sheet then advance to a die cutting machine where individual containers are cut from the continuous sheet. Conventional accumulation, packaging, palletizing, storing, and shipping of the individual containers then occurs.

Figure 34:
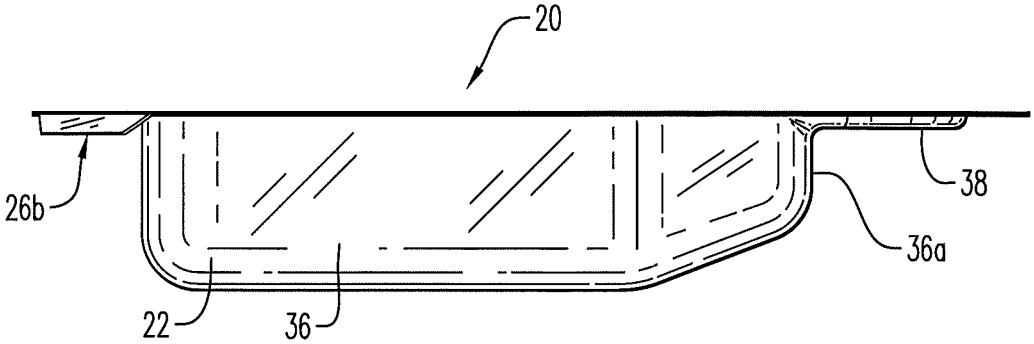
FIG. 34 is a side elevational view of the seventh embodiment of the condiment container.
Figure 35:
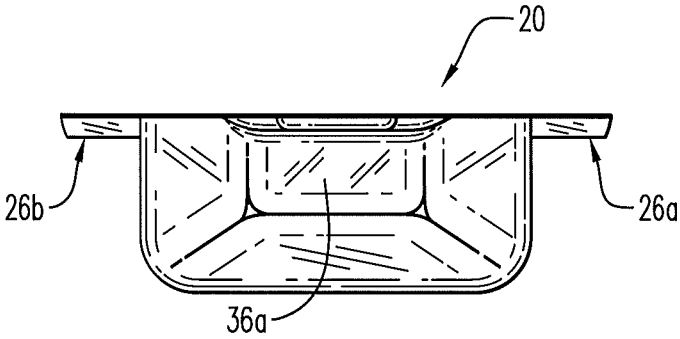
FIG. 35 is a front elevational view of the seventh embodiment of the condiment container.
Figure 36:
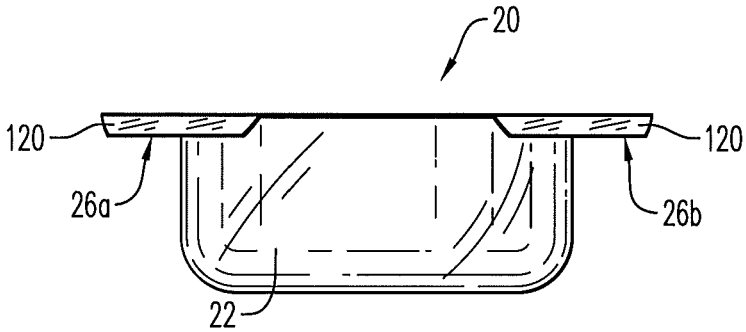
FIG. 36 is a rear elevational view of the seventh embodiment of the condiment container.

A seventh preferred embodiment of the container 20 is depicted in FIGS. 28-40. In that embodiment, the flange 26 is provided with at least one, and preferably two, downwardly offset portions 26*a*, 26*b* which are spaced apart along the non-bonded region 52 (see FIG. 34). Each of the offset portions 26*a*, 26*b* is offset downwardly from the cover portion to form therebetween a finger-access gap 120 which makes it easier for a user to manually grasp and peel-off the cover portion 24. Preferably, the finger access gaps 120 are disposed at opposite ends of the non-bonded region 52, but could be located intermediate those ends if desired. A lower edge of each offset portion 26*a*, 26*b* is bent rearwardly at about a right angle to form a horizontal lip 27 to prevent the gap 120 from being closed in the event the offset portion is pressed toward the underside of the flange 26.

An additional advantageous feature of the seventh embodiment shown in FIGS. 28-40 relates to a configuration of the container sidewall 36 which facilitates compact packaging of a plurality of the containers, for example, in a carton or other packaging device. In that regard, it is desirable to compactly package and transport the containers 20 in such close proximity to one another that the flanges of adjacent containers overlap one another, as shown in FIGS. 37-40. As can be seen in those figures, first and second containers 20*a* and 20*b* are arranged with their spouts in alignment in the longitudinal direction Z. The spout 38 of the first container overlies the rear portion of the second container 20*b*. Additional third and fourth containers 20*c* and 20*d* are also arranged with their spouts longitudinally aligned. The third and fourth containers are also disposed adjacent the first and second containers 20*a*, 20*b*, respectively, in a lateral direction Z' with respect to the longitudinal direction Z, with side portions 26*a* of the flanges of the third and fourth containers 20*c*, 20*d* arranged in overlapping relationship to the side portions of the first and second containers.

In order to enable the tops of the containers, i.e., the cover portions 24 and the flanges 26, of all assembled containers to lie in substantially parallel planes for compact handling, the front portions 36*a* of the container sidewalls 36 are configured to prevent the respective spouts 38 from being displaced, or cammed, upwardly in response to the sidewall front portions being contacted by the rear portions of longitudinally adjacent containers. Preferably, the upper section of the sidewall front portion 36*a* is arranged to extend downwardly relative to the respective flange 38 in a direction which is substantially perpendicular to the plane of the flange, as shown especially in FIG. 40. As a result, when the rear portion of the second container 20*b* makes contact with that upper section when the containers are assembled together in a package, the spout 38 of the first container 20*a* will not be displaced upwardly as could otherwise occur if that upper section were instead inclined in a downward/rearward direction relative to the flange 26.

Thus, by being arranged substantially perpendicular to the plane of the flange 26, the upper section of the sidewall front portion 36*a* will not displace the spout 38 upwardly to any appreciable extent in response to being contacted by the rear portion of another container. That ensures that the containers can be assembled tightly together in overlapping relationship, with the container tops disposed in substantially parallel planes. An alternative way of preventing the spouts from being displaced upwardly involves inclining the upper section of the sidewall front portion 36*a* in a downward/forward direction relative to the flange, but it is preferable to achieve this result by orienting the upper section substantially perpendicular to the plane of the flange.

As can be seen in, e.g., FIGS. 28-38, the seal between the container lid and the container bottom portion may be positioned inwardly from the peripheral edge of the flange. Such an arrangement may be desirable to provide additional tolerance for cutting the finished containers from sheet material used for forming the containers and the lids.

The lid portion 24 and the container portion 22 of the embodiment according to FIGS. 28-40 can be fabricated of the same materials described earlier herein, and each can be fabricated of a material which is transparent, translucent, or opaque, depending of the condiment being stored. The material could also be colored, if desired. The generally planar bottom 32 of the container portion 22 can include an embossed portion 122 to increase the bending stiffness of that planar bottom as shown in FIG. 29.

Figure 41:
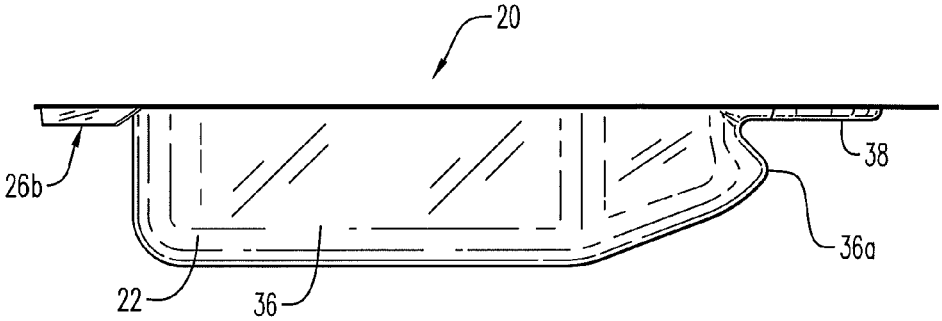
FIG. 41. is a side elevational view of an eighth embodiment of the condiment container, similar to FIG. 34.

The eighth embodiment, depicted in FIG. 41, shows that the front portion 36*a* of the sidewall can be inclined relative to the plane of the flange, essentially in the longitudinal direction Z, such that an acute angle is defined between the plane of the front portion 36*a* and the plane of the flange. Such an arrangement may, for example, be desirable in applications where it is desired to more securely lock or otherwise position the aligned adjacent ends of containers.

Figure 29:
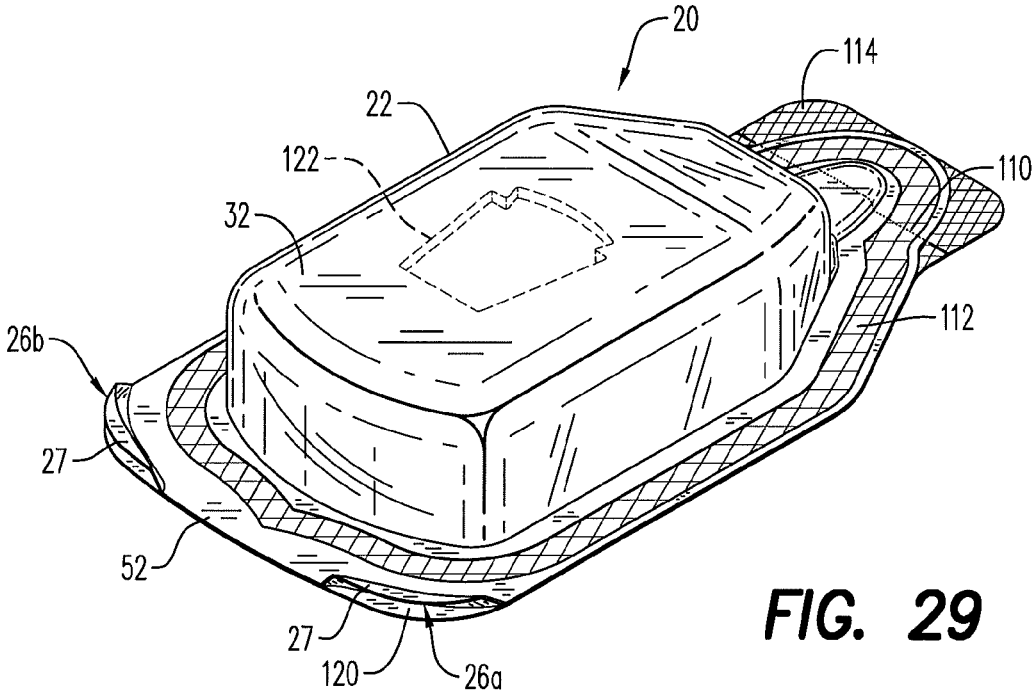
FIG. 29 is a bottom, rear perspective view of the seventh embodiment of the condiment container.
Figure 30:
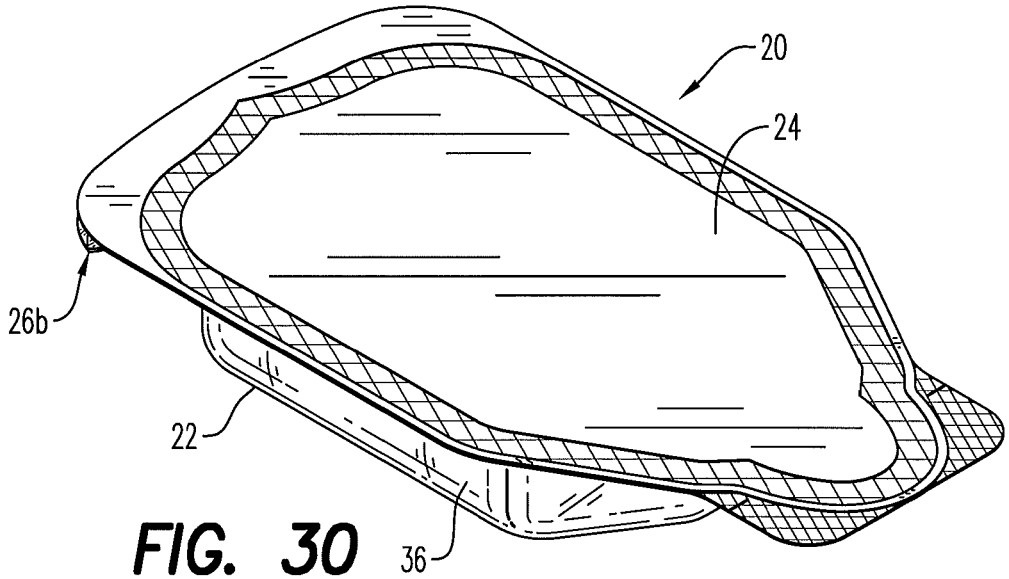
FIG. 30 is a top, front perspective view of the seventh embodiment of the condiment container.
Figure 31:
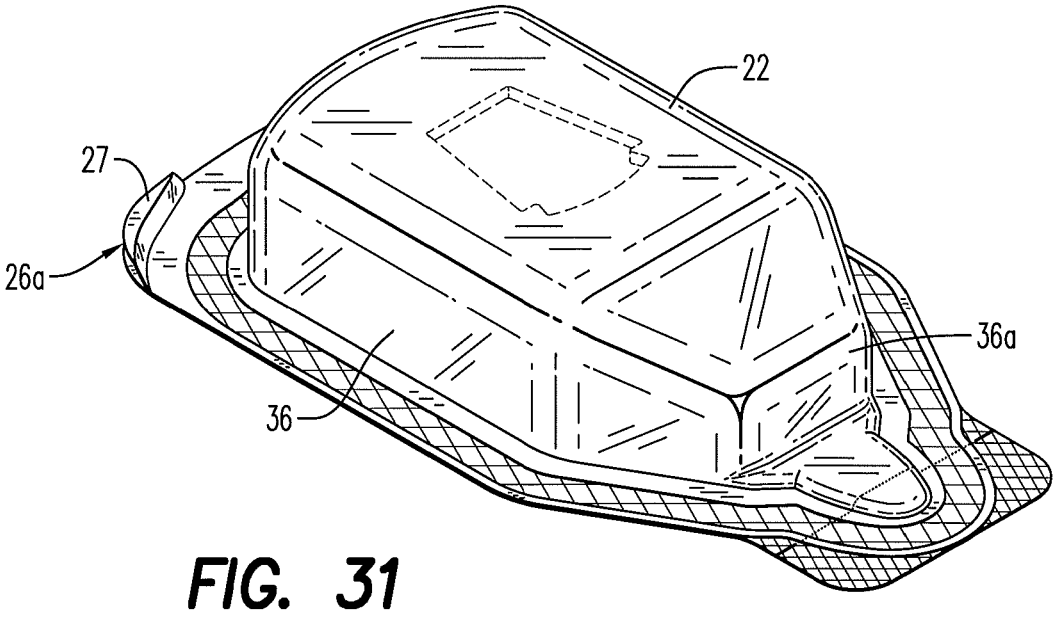
FIG. 31 is a bottom, front perspective view of the seventh embodiment of the condiment container.
Figure 32:
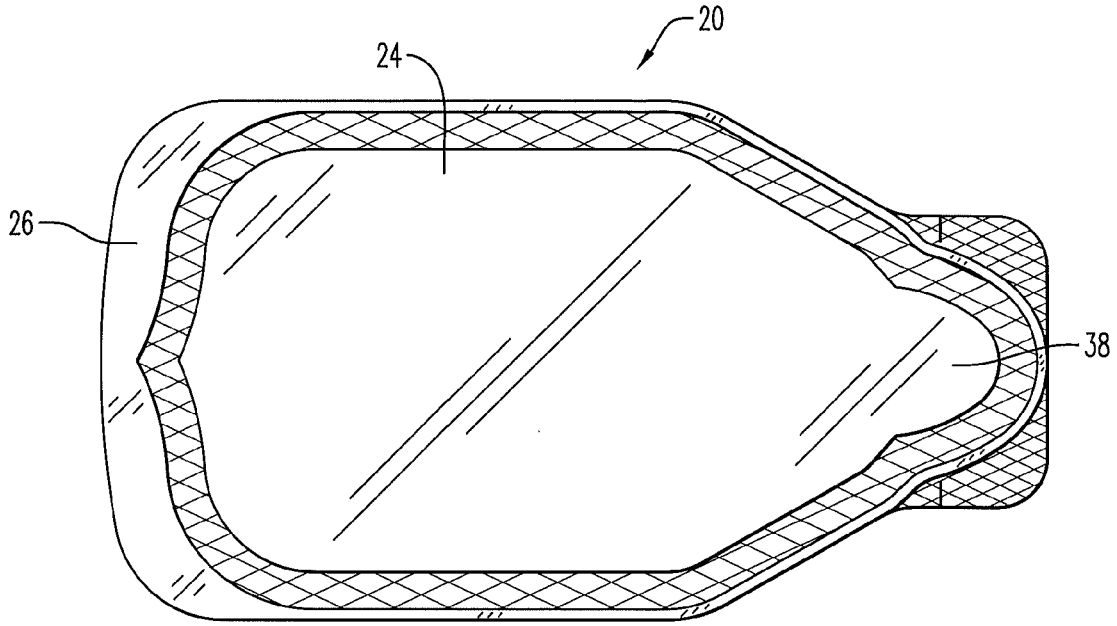
FIG. 32 is a top plan view of the seventh embodiment of the condiment container.
Figure 33:
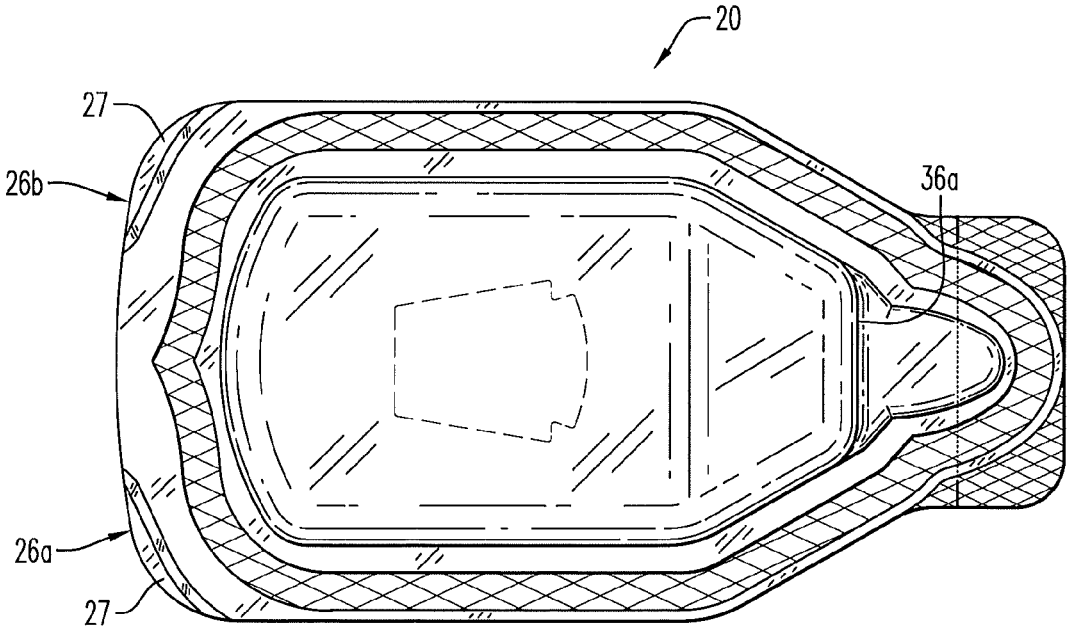
FIG. 33 is a bottom plan view of the seventh embodiment of the condiment container.

Turning briefly to FIG. 29, a score line 110 may be applied to the container lid or to the container bottom using a laser. For many materials, the score line can be applied mechanically, by laser, and/or by any other suitable means. In some applications where APET is used as the material, mechanical creasing or scoring is not preferred because APET tends to be brittle and may inadvertently break and because the APET material is not planar in the region of the spout. The laser score line 110 may be applied to a depth of about 40% to about 60% of the thickness of the APET material in the region of the spout. Preferably the depth of the score line 110 is about 50% of the depth of the APET material.

Suitable equipment for making the score line 110 includes the VideoJet 3320 laser scoring system, operating at a power setting in the range of about 80% to about 100%. The VideoJet 3320 is a 30 watt system. Preferably, the mark speed lies in the range of about 90 to about 225 mm/sec. The VideoJet 3320 is available from Videojet Technologies Ltd., Huntingdon, Campridgeshire PE29 6XX, United Kingdom.

Figure 37:
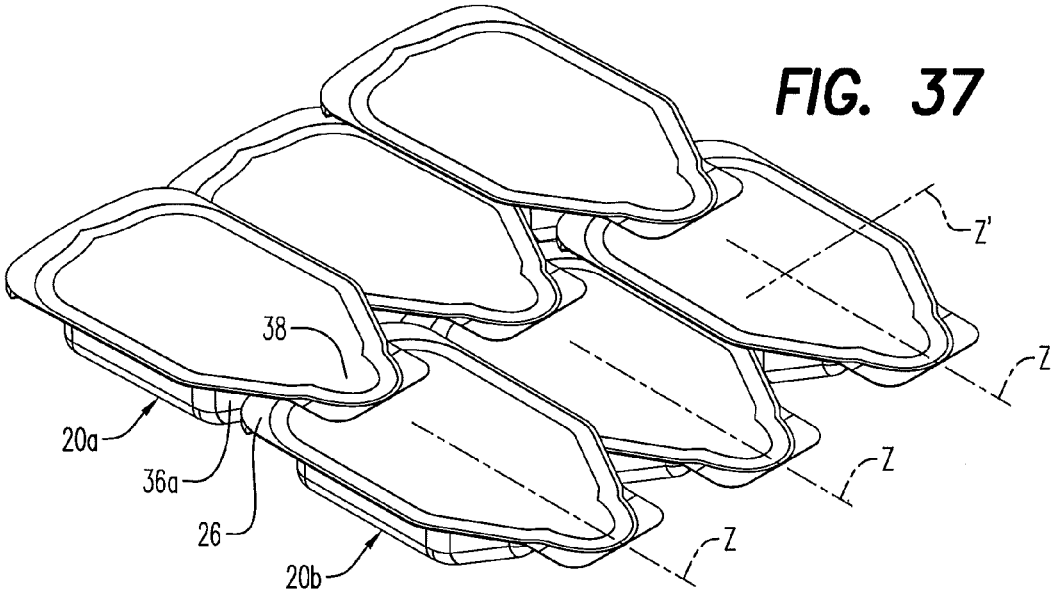
FIG. 37 is a top, front perspective view of a plurality of containers of the seventh embodiment assembled together.
Figure 38:
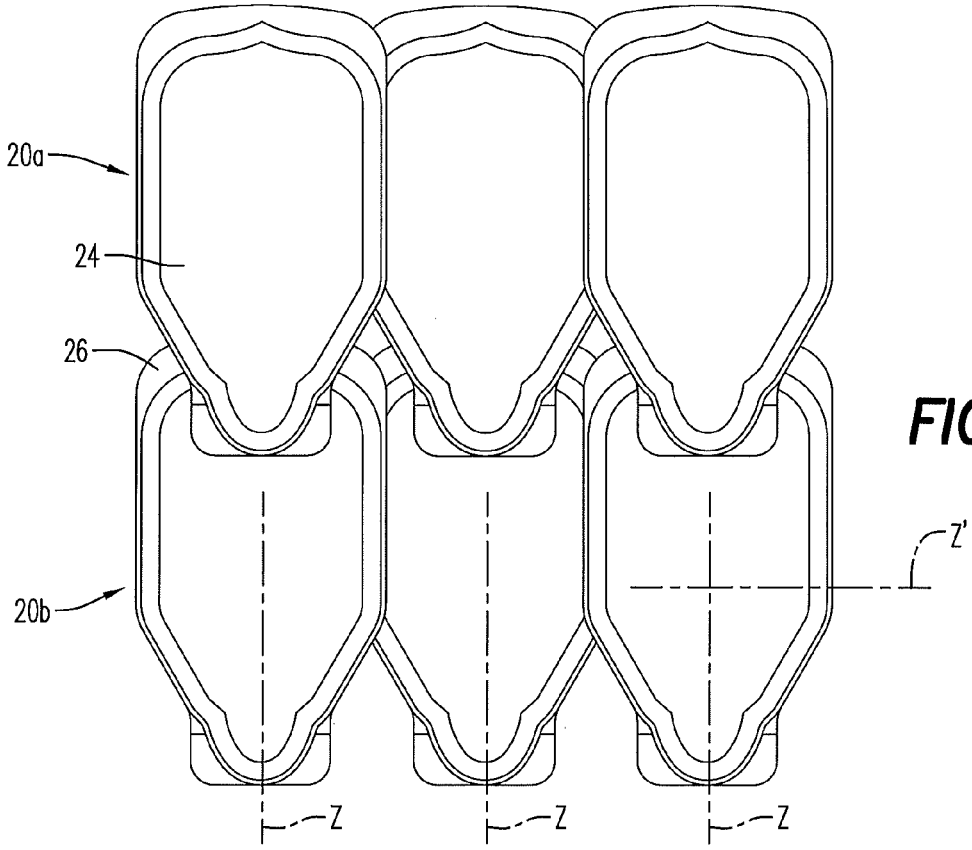
FIG. 38 is a top plan view of the assembly of condiment containers shown in FIG. 37.
Figure 39:
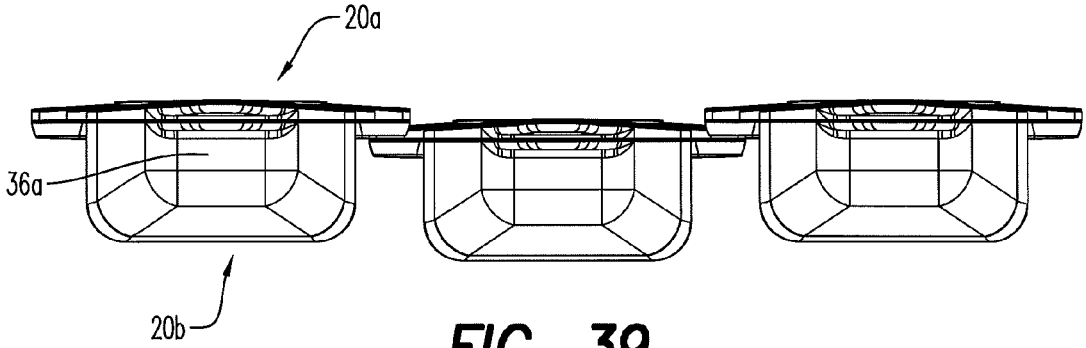
FIG. 39 is a front elevational view of the assembly of condiment containers shown in FIG. 37.
Figure 40:
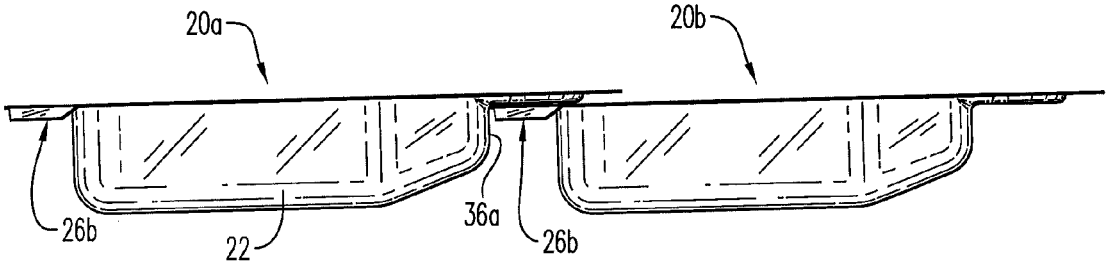
FIG. 40 is a side elevational view of the assembly of condiment containers shown in FIG. 37.

The seal 112 between the cover and the container bottom may be patterned as depicted in FIGS. 1-33, or not patterned as depicted in FIGS. 37-38. Patterning can be intentionally applied. Patterning may result from pressing container surfaces together with patterned surfaces on the pressing dies. Alternatively, the pressing dies may be smooth such that no pattern results.

In some applications it has been observed that resistance to separation between the container top or lid and the container bottom increases in the vicinity of the spout. That resistance appears to be the result of increasing width of the seal transversely of the spout in the region 114 of the container (see FIG. 29). That increased resistance can be modified, reduced, or even eliminated by modifying characteristics of the sealing dies in the vicinity of the spout. For example, the sealing dies can be profiled to provide a graduated seal pressure extending laterally away from the longitudinal direction Z of the containers. Preferably, tackiness of the seal will be stronger adjacent to the spout area itself and will become less strong as the distance from the spout increases.

For some uses of the containers according to this invention, it may be desirable to deploy multiple containers joined together so as to be separable, for example by perforations or some other frangible connection or attachment. To that end, containers may be laterally joined to one another so as to be detachable from one another without rupturing the containers. Such assemblies of multiple containers may include two, three, four, five, or more containers in a strip-like arrangement. Furthermore, two such strip-like arrangements may be connected along the container back ends or edges to provide plural generally parallel strips in an assembly of containers. If further desired, hooks, eyes, or other mounting devices may be attached to the container assemblies to further enhance product display.

While the container described herein is suitable for packaging condiments, it will also be apparent to those skilled in the art that the container has myriad other potential uses and/or applications. For example, and without limitation, containers according to this invention may be used for condiments, sauces, dairy products, soups, pharmaceuticals, paints, powders, liquids, particulate materials, as well as any other product or material for which It may be desirable to have both metered and unmetered access. Expressed differently, the container may be used for any edible material. A suitable edible product or material may be selected from the group consisting of a condiment, a soup, a sauce, a dairy product, a liquid, and combinations thereof. The container may also be used for products or materials selected from the group consisting of a pharmaceutical, a pain, a powder, a liquid, a particulate material, and combinations thereof. Similarly, those skilled in the art will further appreciate that the container can be scaled up or down as needed to provide the appropriate volumetric capacity.

The container can be fabricated using various manufacturing techniques. For example, the container portion may be fashioned using deep draw processes, vacuum forming, or the like. Other available manufacturing processes may provide container walls with features that are corrugated, undulating, bellows-like, ribbed, and/or the like. Such wall features may extend in the longitudinal direction or transversely thereto, as may be desired.

Some applications may also include reclosable ends for the spout and/or a valving arrangement for the spout. It is also contemplated that the material selected for use in the container of this invention may be selected from the group of consisting of recyclable materials, and/or may be selected from the group consisting of sustainable materials.

The word "about" is used in connection with numerical values at various locations throughout this specification with the intent of avoiding mathematical precision for those numerical values. Accordingly, when the word "about" is used in connection with a numerical value or range of values, it is intended that the word "about" should be interpreted as including a tolerance of ±10% around the stated numerical value. To similar effect, the words "generally" and "substantially" are used throughout this specification in connection with various geometric words, terms, and/or phrases. The intent of the words "generally" and "substantially" in such a context is to avoid strict geometrical definitions, to encompass structures which approximate the geometrical definitions, and to include features that are not precisely met by the related terms and/or phrases.

Moreover, it is expressly intended that this invention be interpreted so as to be consistent with all parts of this specification. Thus, the summary, abstract, drawing description, and the like are not intended to be limiting but are intended to summarize some, but not all, features, or to provide an overview of the entire specification, or of a particular drawing.

It will now be apparent to those skilled in the art that this specification describes a new, useful, and nonobvious condiment container. Moreover, it will be apparent to those skilled in the art that numerous modifications, variations, substitutions, and equivalents exist for the various features of the invention described in the appended claims. Accordingly, it is expressly intended that all such modifications, variations, substitutions, and equivalents which fall within the spirit and scope of the invention, as defined in the appended claims, be embraced thereby.

What is claimed is:

1. A container comprising:

a container portion fashioned from a container material having a first bending stiffness, defining a receptacle having a volume and a spout, having a generally planar bottom with a width, having a generally planar flange generally parallel to the planar bottom, spaced therefrom, and surrounding the receptacle, having a sidewall extending between the bottom and the flange;

a removable cover portion fashioned from a cover material having a second bending stiffness which is less than the first bending stiffness, the cover portion substantially covering the generally planar flange;

adhesive between the container portion and the cover portion in the region of the generally planar flange, such that there exists a non-bonded region between the cover portion and the flange portion to facilitate removal of the cover portion;

wherein the sidewall includes a front portion disposed below the spout at a location offset from a discharge end of the spout, an upper section of the sidewall front portion extending downwardly with respect to the spout in a direction substantially perpendicular to a plane of the flange, wherein the cover portion and the flange form a bonded region substantially along a perimeter of the receptacle, and the cover portion and the flange additionally form a securing region structured and arranged with an increased peeling resistance relative to a peeling resistance of the bonded region, and wherein the bonded region and the securing region are formed with first and second different sealing die patterns, such that the bonded region has a first sealing pattern and the securing region has a second sealing pattern, wherein the first and second sealing patterns are different.

2. The container of claim 1, further including an embossed portion in the generally planar bottom operable to increase the bending stiffness of that generally planar bottom.

3. The container of claim 1, including an embossed portion in the generally planar bottom.

4. The container of claim 1, wherein the container portion and the cover portion include a generally symmetrical pair of cuts extending from sides of the container toward a container end so as to define a pair of ears.

5. The container of claim 4, wherein the ears include a surface adhering treatment.

6. The container of claim 1, wherein the container portion is fabricated from material having an oxygen control barrier.

7. The container of claim 1, wherein the cover portion is fabricated from a material having an oxygen control barrier.

8. The container of claim 1, further including a peel initiator located in longitudinal alignment with the spout portion.

9. The container of claim 8, wherein the peel initiator is located opposite from the spout portion.

10. The container of claim 1, wherein the adhesive provides a resistance to peeling in the range of about 2 to about 10 pounds force.

11. The container of claim 1, wherein the receptacle has a width, a depth, and a length, and is proportioned such that the depth is less than about 50% of the width, and the depth is less than about 35% of the length.

12. The container of claim 1, wherein the container can support an applied weight of about 50 lbs.

13. The container of claim 1, wherein the receptacle contains a condiment.

14. The container of claim 1, wherein the receptacle contains a condiment selected from the group consisting of ketchup, mayonnaise, and sauce.

15. The container of claim 14, wherein the receptacle contains ketchup.

16. The container of claim 1, wherein the container material and the cover material are selected such that the condiment has a shelf-life of at least about six months.

17. The container of claim 16, wherein shelf-life is determined using a colorimeter operating in the L*a*b* color space, and an L*-value does not degrade more than about 10% during a six-month period.

18. The container of claim 1, wherein the cover portion includes a foil layer.

19. The container of claim 1, wherein the cover portion and the container portion are opaque.

20. The container of claim 1, where in the material of the cover portion is selected from the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, and combinations thereof.

21. The container of claim 19, wherein the cover portion includes at least two layers, at least one layer selected from the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, and combinations thereof.

22. The container of claim 1, wherein the thickness of the cover portion lies in the range of about 1 mil to about 5 mils.

23. The container of claim 1, where in the material of the container portion is selected from the group consisting of PET, APET, OPET, MET-PET, PE, LDPE, LLDPE, mLL- DPE, HDPE, mPE, EVA, PP, mOPP, PS, HIPS, foil, EVOH, polyamide, Nylon, PVC, biaxially oriented materials, and combinations thereof.

24. The container of claim 22, wherein the container portion includes at least two layers, at least one layer selected from the group consisting of PET, APET, OPET, MET-PET, PE, LOPE, LLDPE, mLLDPE, HDPE, mPE, EVA, PP, mOPP, PS, HIPS, foil, EVOH, polyamide, Nylon, PVC, biaxially oriented materials, and combinations thereof.

25. The container of claim 1, wherein the thickness of the container portion lies in the range of about 3 mils to about 20 mils.

26. The container of claim 1 wherein the container envelops a product or material and provides both metered and unmetered access thereto.

27. The container of claim 26 wherein the product or material is edible.

28. The container of claim 27 wherein the product or material includes a condiment, a sauce, a dairy product, a soup, or a liquid.

29. The container of claim 26 wherein the product or material includes a pharmaceutical, a paint, a powder, a liquid, or a particulate material.

30. The container of claim 1, wherein the securing region is arranged beyond a perimeter of the bonded region.

31. The container of claim 1, wherein the securing region is arranged proximate the spout.

32. The container of claim 1, wherein the container portion comprises APET.

33. The container of claim 1, further including a weakened region in substantially transverse alignment with the spout, wherein the container portion and the cover portion are breakable along the weakened region so as to remove a portion of the cover portion and a portion of the container portion and expose the spout.

34. The container of claim 33, wherein the weakened region including a pair of aligned cuts, positioned on corresponding sides of the spout.

35. The container of claim 33, wherein the weakened region is applied mechanically.

36. The container of claim 33, wherein the weakened region comprises a laser score.

37. A container comprising:

a container portion fashioned from a container material having a first bending stiffness, defining a receptacle having a volume and a spout, having a generally planar bottom with a width, having a generally planar flange generally parallel to the planar bottom, spaced therefrom, and surrounding the receptacle;

a manually removable cover portion fashioned from a cover material having a second bending stiffness which is less that the first bending stiffness, the cover portion substantially covering the generally planar flange;

adhesive between the container portion and the cover portion in the region of the generally planar flange, such that there exists a non-bonded region between the cover portion and the flange, to facilitate manual removal of the cover portion;

wherein at least one section of the flange in the non-bonded region is offset downwardly away from the cover portion to form therebetween a finger-access gap for facilitating manual gripping of the cover portion, wherein the cover portion and the flange form a bonded region substantially along a perimeter of the receptacle, and the cover portion and the flange additionally form a securing region structured and arranged with an increased peeling resistance relative to a peeling resistance of the bonded region, and wherein the bonded region and the securing region are formed with first and second different sealing die patterns, such that the bonded region has a first sealing pattern and the securing region has a second sealing pattern, wherein the first and second sealing patterns are different.

38. The container of claim 37, wherein the non-bonded region extends along a side of the receptacle disposed opposite the spout and includes opposite ends, there being a finger-access gap at each end of the non-bonded region.

39. The container of claim 37, wherein a lower edge of each offset portion is bent rearwardly to form a generally horizontal lip.

40. The container of claim 37, further including an embossed portion in the generally planar bottom operable to increase the bending stiffness of that generally planar bottom.

41. The container of claim 37, including an embossed portion in the generally planar bottom.

42. The container of claim 37, wherein the container portion and the cover portion include a generally symmetrical pair of cuts extending from sides of the container toward a container end so as to define a pair of ears.

43. The container of claim 42, wherein the ears include a surface adhering treatment.

44. The container of claim 37, wherein the container portion is fabricated from material having an oxygen control barrier.

45. The container of claim 37, wherein the cover portion is fabricated from a material having an oxygen control barrier.

46. The container of claim 37, further including a peel initiator located in longitudinal alignment with the spout portion.

47. The container of claim 46, wherein the peel initiator is located opposite from the spout portion.

48. The container of claim 37, further including a weakened region including a pair of aligned cuts, positioned on corresponding sides of the spout.

49. The container of claim 48, wherein the weakened region is applied mechanically.

50. The container of claim 48, wherein the weakened region comprises a laser score.

51. The container of claim 37, wherein the adhesive provides a resistance to peeling in the range of about 2 to about 10 pounds force.

52. The container of claim 37, wherein the receptacle has a width, a depth, and a length, and is proportioned such that the depth is less than about 50% of the width, and the depth is less than about 35% of the length.

53. The container of claim 37, wherein the container can support an applied weight of about 50 lbs.

54. The container of claim 37, wherein the receptacle contains a condiment.

55. The container of claim 37, wherein the receptacle contains a condiment selected from the group consisting of ketchup, mayonnaise, and sauce.

56. The container of claim 55, wherein the receptacle contains ketchup.

57. The container of claim 56, wherein the container material and the cover material are selected such that the condiment has a shelf-life of at least about six months.

58. The container of claim 57, wherein shelf-life is determined using a colorimeter operating in the L*a*b* color space, and a L*-value does not degrade more than about 10% during a six-month period.

59. The container of claim 37, wherein the cover portion includes a foil layer.

60. The container of claim 37, wherein the cover portion and the container portion are opaque.

61. The container of claim 37, where in the material of the cover portion is selected from the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, and combinations thereof.

62. The container of claim 60, wherein the cover portion includes at least two layers, at least one layer selected from the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, and combinations thereof.

63. The container of claim 37, wherein the thickness of the cover portion lies in the range of about 1 mil to about 5 mils.

64. The container of claim 37, where in the material of the container portion is selected from the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, and combinations thereof.

65. The container of claim 62, wherein the container portion includes at least two layers, at least one layer selected from the group consisting of PET, APET, OPET, MET-PET, PE, LDPE, LLDPE, mLLDPE, HDPE, mPE, EVA, PP, mOPP, PS, HIPS, foil, EVOH, polyamide, Nylon, PVC, biaxially oriented materials, and combinations thereof.

66. The container of claim 37, wherein the thickness of the container portion lies in the range of about 3 mils to about 20 mils.

67. An assembly of a plurality of containers, each container comprising:

a container portion fashioned from a container material having a first bending stiffness, defining a receptacle having a volume and a spout extending in a longitudinal direction of the receptacle, having a generally planar bottom with a width, having a generally planar flange generally parallel to the planar bottom, spaced therefrom, and surrounding the receptacle, with a rear portion of the flange disposed opposite the spout, having a sidewall extending between the bottom and the flange and including a sidewall front portion disposed below the spout at a location offset from a discharge end thereof and extending downwardly with respect to the spout;

a removable cover portion fashioned from a cover material having a second bending stiffness which is less that the first bending stiffness, the cover portion substantially covering the generally planar flange;

adhesive between the container portion and the cover portion in the region of the generally planar flange, such that there exists a non-bonded region between the cover portion and the flange to facilitate removal of the cover portion;

wherein the plurality of containers includes first and second containers disposed adjacent one another with their respective spouts in mutual alignment and with the spout of the first container arranged in overlapping relationship to the rear portion of the flange of the second container, an upper section of the sidewall front portion extending downwardly with respect to the spout and configured to prevent the spout of the first container from being displaced upwardly in response to the upper section of the sidewall front portion being contacted by the rear portion of the flange of the second container, wherein the cover portion and the flange form a bonded region substantially along a perimeter of the receptacle, and the cover portion and the flange additionally form a securing region structured and arranged with an increased peeling resistance relative to a peeling resistance of the bonded region, and wherein the bonded region and the securing region are formed with first and second different sealing die patterns, such that the bonded region has a first sealing pattern and the securing region has a second sealing pattern, wherein the first and second sealing patterns are different.

68. The assembly of containers according to claim 67, wherein the upper section of the sidewall front portion is disposed substantially perpendicular to a plane of the flange.

69. The assembly of containers according to claim 67, wherein the plurality of containers includes additional containers disposed adjacent the first and second containers in a lateral direction with respect to the longitudinal direction, wherein flanges of the first and second containers and respective flanges of the additional containers are disposed in mutually overlapping relationship in the lateral direction.

70. A package comprising a box and an assembly of a plurality of containers disposed in the box, wherein each container comprises:

a container portion fashioned from a container material having a first bending stiffness, defining a receptacle having a volume and a spout extending in a longitudinal direction of the receptacle, having a generally planar bottom with a width, having a generally planar flange generally parallel to the planar bottom, spaced therefrom, and surrounding the receptacle, with a rear portion of the flange disposed opposite the spout, having a sidewall extending between the bottom and the flange and including a sidewall front portion extending downwardly from an underside of the spout;

a removable cover portion fashioned from a cover material having a second bending stiffness which is less that the first bending stiffness, the cover portion substantially covering the generally planar flange;

adhesive between the container portion and the cover portion in the region of the generally planar flange, such that there exists a non-bonded region between the cover portion and the flange to facilitate removal of the cover portion;

wherein the plurality of containers includes first and second containers disposed adjacent one another with their respective spouts in mutual alignment and with the spout of the first container arranged in overlapping relationship to the rear portion of the flange of the second container, an upper section of the sidewall front portion extending downwardly with respect to the spout and configured to prevent the spout of the first container from being displaced upwardly in response to the upper section of the sidewall front portion being contacted by the rear portion of the flange of the second container, wherein the cover portion and the flange form a bonded region substantially along a perimeter of the receptacle, and the cover portion and the flange additionally form a securing region structured and arranged with an increased peeling resistance relative to a peeling resistance of the bonded region, and wherein the bonded region and the securing region are formed with first and second different sealing die patterns, such that the bonded region has a first sealing pattern and the securing region has a second sealing pattern, wherein the first and second sealing patterns are different.

71. The assembly of containers according to claim 70, wherein the upper section of the sidewall front portion is disposed substantially perpendicular to a plane of the flange.

72. The assembly of containers according to claim 70, wherein the plurality of containers includes additional containers disposed adjacent the first and second containers in a lateral direction with respect to the longitudinal direction, wherein flanges of the first and second containers and respective flanges of the additional containers are disposed in mutually overlapping relationship in the lateral direction.

* * * * *